US006482038B2

(12) United States Patent
Olson

(10) Patent No.: US 6,482,038 B2
(45) Date of Patent: Nov. 19, 2002

(54) HEADER ASSEMBLY FOR MOUNTING TO A CIRCUIT SUBSTRATE

(75) Inventor: Stanley W. Olson, East Berlin, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/792,119

(22) Filed: Feb. 23, 2001

(65) Prior Publication Data

US 2002/0119701 A1 Aug. 29, 2002

(51) Int. Cl.[7] ..... H01R 13/648
(52) U.S. Cl. ..... 439/608
(58) Field of Search ..... 439/607, 608, 439/45, 108, 101, 822

(56) References Cited

U.S. PATENT DOCUMENTS

| | | | | | |
|---|---|---|---|---|---|
| 5,174,770 | A | | 12/1992 | Sasaki et al. | 439/108 |
| 5,197,893 | A | * | 3/1993 | Morlion et al. | 439/101 |
| 5,330,371 | A | | 7/1994 | Andrews | 439/579 |
| 5,399,104 | A | | 3/1995 | Middlehurst et al. | 439/608 |
| 5,518,422 | A | | 5/1996 | Zell et al. | 439/608 |
| 5,620,340 | A | * | 4/1997 | Andrews | 439/608 |
| 5,664,968 | A | * | 9/1997 | Mickievicz | 439/608 |
| 5,668,408 | A | | 9/1997 | Nicholson | 257/699 |
| 5,775,947 | A | | 7/1998 | Suzuki et al. | 439/608 |
| 5,782,656 | A | | 7/1998 | Zell et al. | 439/579 |
| 5,803,768 | A | | 9/1998 | Zell et al. | 439/608 |
| 5,882,227 | A | | 3/1999 | Neidich | 439/608 |
| 6,027,345 | A | | 2/2000 | McHugh et al. | 439/66 |
| 6,116,926 | A | * | 9/2000 | Ortega et al. | 439/108 |
| 6,210,227 | B1 | * | 4/2001 | Yamasaki et al. | 439/608 |
| 6,220,896 | B1 | * | 4/2001 | Bertoncini et al. | 439/608 |

* cited by examiner

*Primary Examiner*—Tulsidas Patel
(74) *Attorney, Agent, or Firm*—Woodcock Washburn LLP

(57) ABSTRACT

An electrical connector has a base defining a plurality of aperture spaces therein. A plurality of contacts are received and secured within the aperture spaces, and include signal contacts and ground contacts. In addition, a plurality of ground shields are received and secured within the aperture spaces. The ground shields are positioned to shield selected ones of the signal contacts from noise and/or cross-talk generated by other signal contacts within the base. Each ground shield has an electrical contact site at which the ground shield is in physical and electrical contact with a ground contact. The electrical contact site is flexible.

48 Claims, 14 Drawing Sheets

HEADER ASSEMBLY FOR MOUNTING TO A CIRCUIT SUBSTRATE

CROSS-REFERENCE TO RELATED APPLICATION

This application contains subject matter related to the subject matter disclosed in U.S. patent application Ser. No. 08/942,084, filed Oct. 1, 1997; U.S. patent application Ser. No. 09/045,660, filed Mar. 20, 1998; U.S. patent application Ser. No. 09/295,504, filed Apr. 21, 1999, now U.S. Pat. No. 6,116,926; and U.S. patent application Ser. No. 09/302,027, filed Apr. 29, 1999, each of which is hereby incorporated by reference.

FIELD OF THE INVENTION

The present invention relates to a header assembly for mounting to a circuit substrate and for receiving a complementary electrical connector. In particular, the present invention is for a high density header assembly for use in, for example, a motherboard in a backplane/back panel application.

BACKGROUND OF THE INVENTION

In a typical electrical interconnection system, a first removably insertable circuit board includes a complementary electrical connector that is to be mated with a header assembly or header which is mounted to a second circuit board. As should be understood, when the first circuit board is coupled to the second circuit board by way of the electrical connector and header and when the first circuit board is in operation, a number of signals enter or leave the first circuit board through conductive paths defined by the electrical connector on the first circuit board and the header on the second circuit board. In many instances, the second circuit board has other circuit boards coupled thereto by other respective headers and complementary electrical connectors, and the aforementioned signals can originate from or be destined for such other circuit boards. Of course, the aforementioned signals can also originate from or be destined for other locations remote from the second circuit board by way of appropriate interconnections.

If it is desirable to suppress signal noise and/or cross-talk, it is known that a signal may be transmitted over a pair of differential (positive and negative) signal lines that travel together in close proximity. Typically, in such pair of differential lines, the signal itself (+V) is transmitted on the positive line, and the negation of the signal (−V) is transmitted on the negative line. Since both lines travel together in close proximity, any noise encountered by the lines should appear in a generally identical form on both lines. Accordingly, the subtraction (by appropriate circuitry or other means) of the negative line (−V+noise) from the positive line (+V+noise) should cancel out such noise ((+V+noise)−(−V+noise)=2V), thus leaving the original signal, perhaps with a different amplitude.

Oftentimes, in a high frequency environment, most every signal passing to and from a circuit board travels as a pair of differential signals on a pair of differential signal lines. Accordingly, the electrical connector on the circuit board and the header on the backplane must accommodate all such pairs of differential signal lines. Moreover, with increased contact density on a circuit board, there has been a corresponding increase in signal lines associated with such circuit board. As a result, the number of individual lines running through the electrical connector of the circuit board and the associated header can be quite large. At the same time, since it is desirable to increase the number of circuit boards that can be coupled to the backplane, the 'real estate' on the backplane used by the header must be kept small. Therefore, the 'density' of individual signals that pass through the electrical connector and header must be increased.

With such increased density, however, the issue of susceptibility to noise and/or cross-talk again arises, even in electrical connectors and headers that transmit pairs of differential signals. To combat such density-based noise, the header in particular has been modified to include ground shielding which substantially electromagnetically isolates within the header each pair of differential signal lines from every other pair of differential signal lines.

Accordingly, a need exists for a header that can have multiple differential signal pairs in relatively high density, and that has ground shielding for the signal pins, where the header is practical and relatively easily manufactured.

An example of such a header is disclosed in U.S. patent application Ser. No. 09/302,027, as was disclosed and incorporated by reference above. Such a header has proven to be remarkably capable of reducing noise and/or cross-talk. However, the particular design of the header disclosed in such application does not have an especially high tolerance for margins of error in dimensions of parts thereof. For example, the features responsible for maintaining interference fits of such parts are not flexible, and accordingly, fail to in fact effectuate such interference fits if not dimensionally precise.

That is, most header parts re inserted into apertures in a header base and held therein by interference fits assisted by various interfacing bumps on the parts. In particular, if an aperture in the header base is slightly too wide, or if an interfacing bump on a part that is to be inserted into the aperture is slightly too short, such bump will not contact the inner wall of such aperture once the part is inserted, and will not help to hold the part within the aperture by way of an interference fit. As a result, intermittent electrical connection could occur. Also, the part can fall out of the base. Conversely, if an aperture in the header base is slightly too narrow, or if an interfacing bump on a part that is to be inserted into the aperture is slightly too tall, such bump will exert excessive force on the inner wall of such aperture once the part is inserted, and may in fact result in excessive strain on the base which can lead to immediate or eventual structural failure. As a result, the header is destroyed.

Accordingly, and moreover, a need exists for such a header wherein the header has a relatively high tolerance for margins of error in dimensions of parts thereof.

SUMMARY OF THE INVENTION

The present invention satisfies the aforementioned need by providing an electrical connector that has a base defining a plurality of aperture spaces therein. A plurality of contacts are received and secured within the aperture spaces, and include signal contacts and ground contacts. In addition, a plurality of ground shields are received and secured within the aperture spaces.

The ground shields are positioned to shield selected ones of the signal contacts from noise and/or cross-talk generated by other signal contacts within the base. Each ground shield has an electrical contact site at which the ground shield is in physical and electrical contact with a ground contact. The electrical contact site is flexible.

BRIEF DESCRIPTION OF THE DRAWINGS

The foregoing summary, as well as the following detailed description of preferred embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF PREFERRED EMBODIMENTS

Figure 1:
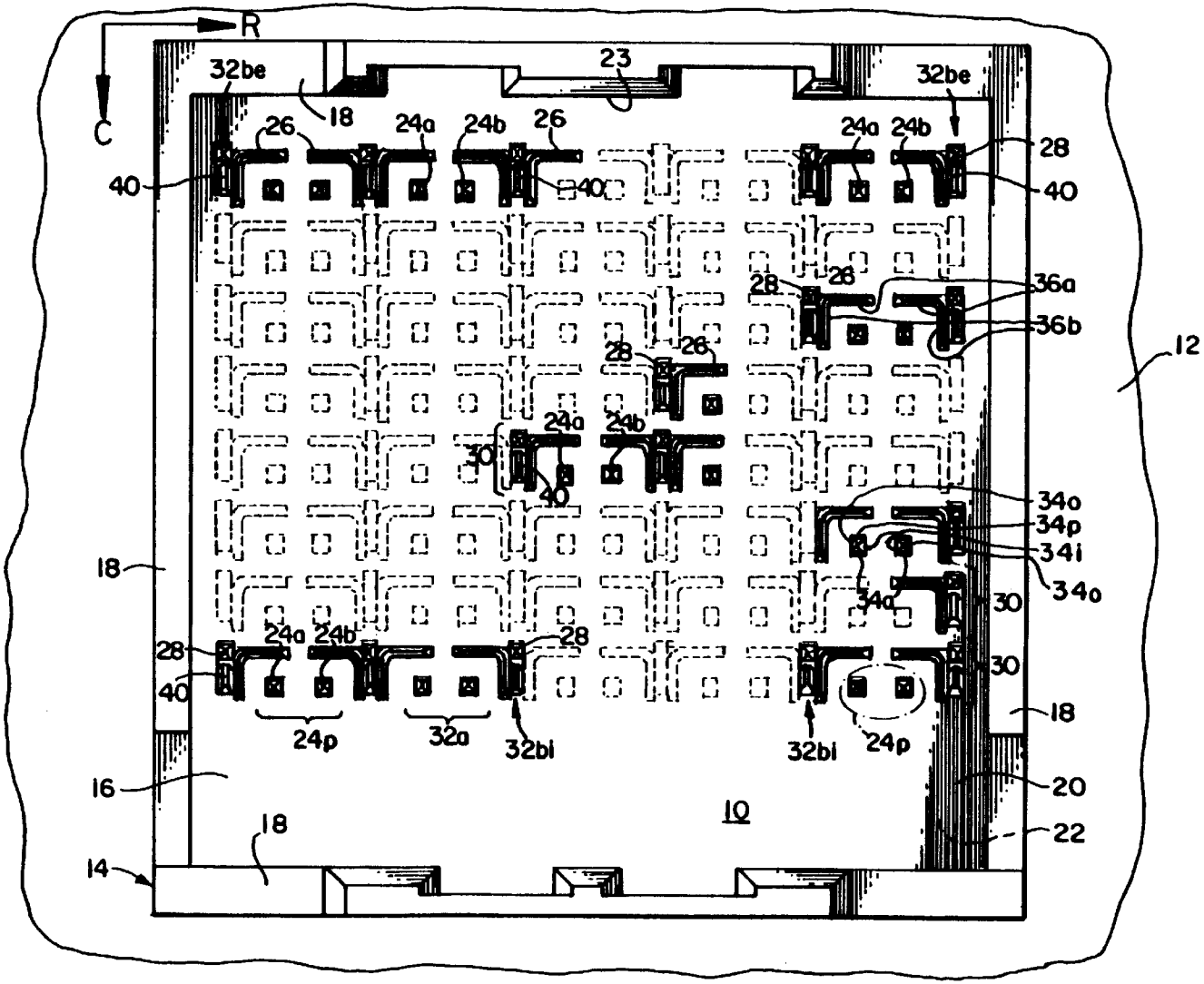
FIG. 1 is a plan view of a connector side of a header, and shows such header mounted to a backplane.

Certain terminology may be used in the following description for convenience only and is not considered to be limiting. For example, the words "left", "right", "upper", and "lower" designate directions in the drawings to which reference is made. Likewise, the words "inwardly" and "outwardly" are directions toward and away from, respectively, the geometric center of the referenced object. The terminology includes the words above specifically mentioned, derivatives thereof, and words of similar import.

Referring to the drawings in detail, wherein like numerals are used to indicate like elements throughout, there is shown in FIG. 1 a header assembly or header 10. The header 10 as shown in FIG. 1 and FIGS. 2–7B is disclosed in U.S. patent application Ser. No. 09/302,027, as was disclosed and incorporated by reference above, and is discussed herein for background and reference purposes. As seen, the header 10 is mounted to a circuit substrate such as a backplane 12 in a position to receive a complementary electrical connector (not shown) on a circuit board (not shown) to be coupled to the backplane 12 by way of the electrical connector and header 10.

As seen, the header 10 includes an insulating shroud 14 which has a base 16. As should be understood, when the header 10 is mounted to the backplane 12, the base 16 of the shroud 14 of the header 10 is generally parallel to such backplane 12. Typically, although not necessarily, the shroud 14 of the header 10 also has walls 18 that extend away from the base 16 at generally right angles thereto. Accordingly, the walls 18 form a well within which the electrical connector is inserted while mating to the header 10. Typically, the walls 18 align and guide the electrical connector as it is being inserted so as to ensure a proper connection and so as to prevent damage that may occur from mis-alignment. The walls 18 may include one or more keying elements (the slots shown, for example) that mate to corresponding keying elements in the electrical connector to further ensure a proper connection and for polarization.

As should be understood, and as seen in FIG. 1, the base 16 of the shroud 14 has a connector side 20 that faces toward the mating connector, and a backplane side 22 that faces toward the backplane 12. The base 16 of the shroud 14 also has a primary edge 23, which as will be explained below is designated as such for purposes of being a fixed reference in the present disclosure. As seen in FIG. 1, the primary edge 23 runs along the top of the base 16.

Header 10 includes signal contacts, ground contacts, and ground shields. In a differential pair application such as that shown in FIG. 1, the header 10 has a plurality of pairs 24*p* of differential signal pins 24*a*, 24*b*, a plurality of ground shields 26, and a plurality of ground pins 28. As should be understood, for purposes of clarity, only a few of the elements 24*a*, 24*b*, 24*p*, 26 and 28 are shown in detail, while the remainder of such elements are shown in phantom. As seen, each pair 24*p* of signal pins 24*a*, 24*b*, each ground shield 26, and each ground pin 28 is mounted to the base 16 of the shroud 14. Each signal pin 24*a*, 24*b* and each ground pin 28 extends away from the base 16 from both the connector side 20 and the backplane side 22 in opposing directions generally perpendicular to such base 16, as can be seen in and/or appreciated from FIGS. 1–4.

Alternatively, in the case where the header 10 is to be surface mounted to the backplane 12 (not shown), each signal pin 24*a*, 24*b* and each ground pin 28 may extend away from the base 16 from the connector side 20 only. Any surface mounting technology may be employed in such a circumstance without departing from the spirit and scope of the present invention. For example, Ball Grid Array technology such as that disclosed in PCT Publication No. WO 98/15991, hereby incorporated by reference, may be employed.

As can be seen in FIG. 1, the pairs 24*p* of signal pins 24*a*, 24*b* are arranged into a plurality of rows 30 extending in a first direction (as indicated by the arrow R) along the base 16 and along the primary edge 23 of the base 16. That is to say, the rows 30 and the first direction run along the surface of the base 16, and generally parallel to the primary edge 23. Additionally, the pairs 24*p* of signal pin 24*a*, 24*b* are further arranged into a plurality of columns 32*a* that extend in a second direction (as indicated by the arrow C) along the base 16 generally perpendicular to the first direction. Again, that is to say, the columns 32*a* and the second direction run along the surface of the base 16, and generally perpendicular to the primary edge 23. To summarize, then, the pairs 24*p* of signal pins 24*a*, 24*b* are arranged generally rectilinearly.

Still referring to FIG. 1, the signal pins 24*a*, 24*b* in each pair 24*p* are adjacently arranged into a sub-row that extends in the first direction (arrow R). Accordingly, each row 30 has X pairs 24*p* of signal pin 24*a*, 24*b* and 2X individual signal pins 24*a*, 24*b*. Correspondingly, each column 32 has Y pairs 24*p* of signal pins 24*a*, 24*b*, and 2Y individual signal pins 24*a*, 24*b*.

Figure 2:
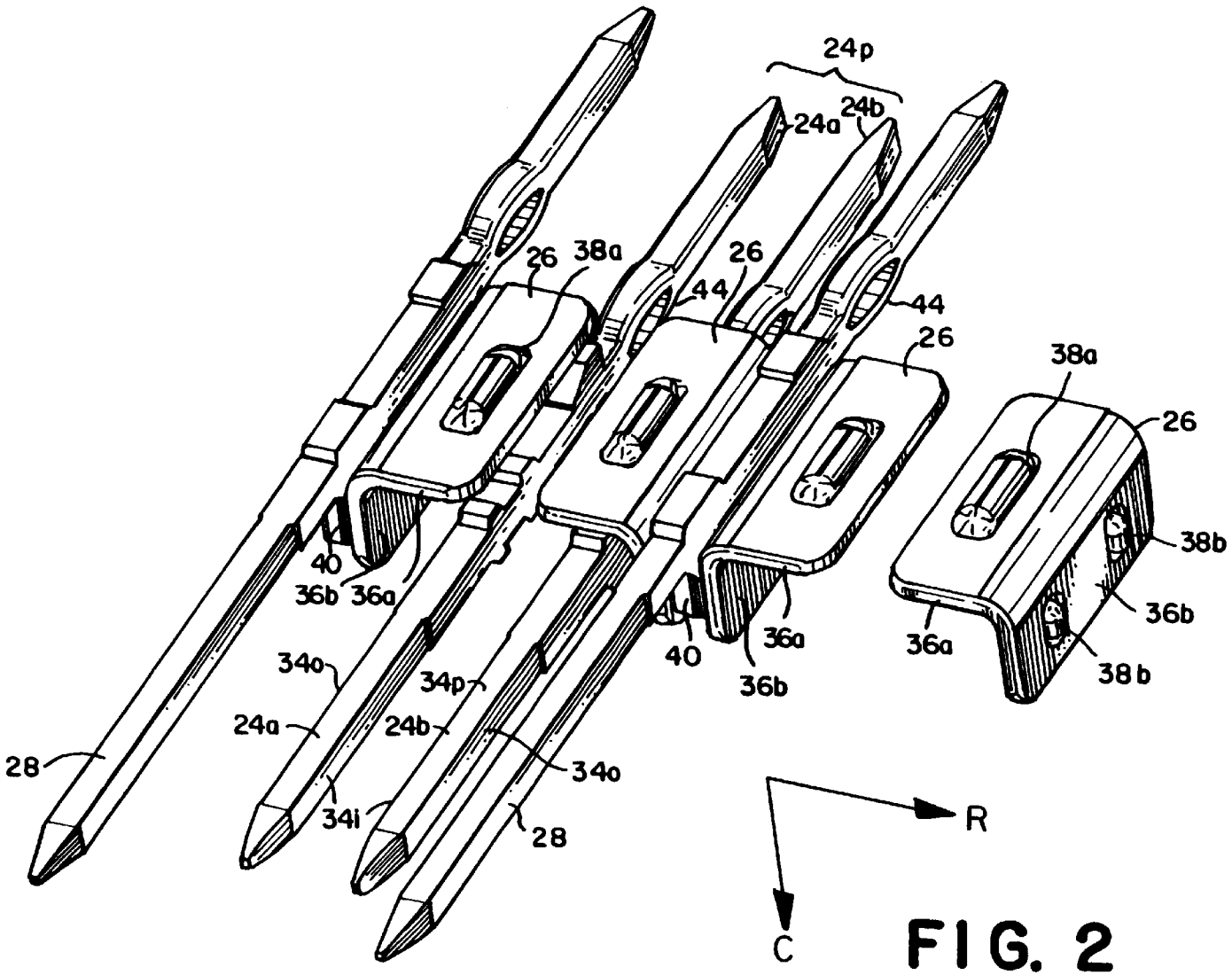
FIG. 2 is a perspective view of a portion of the pins and ground shields of the header of FIG. 1, with the shroud of FIG. 1 removed for clarity.
Figure 3:
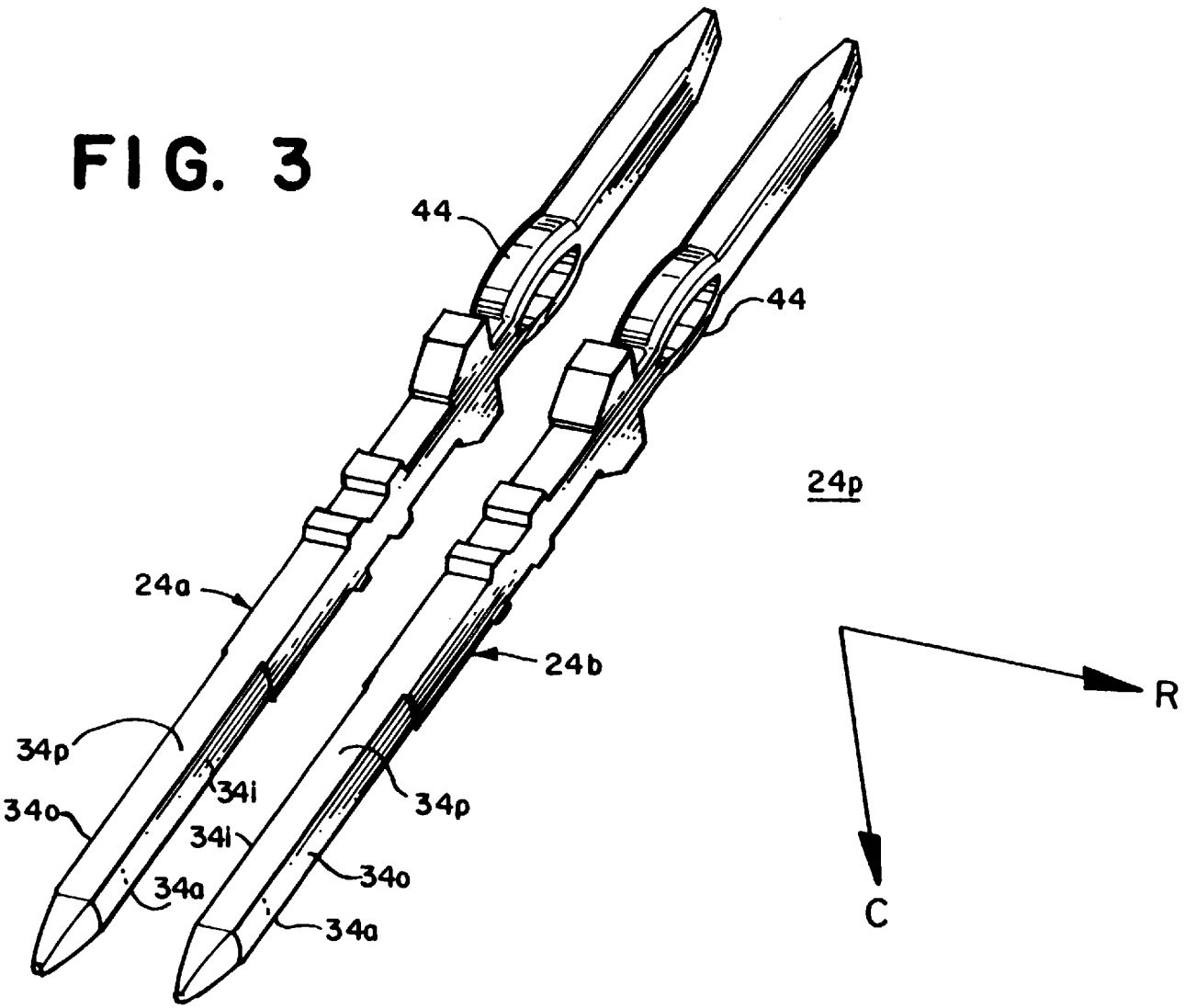
FIG. 3 is the same perspective view of FIG. 2, but shows only the pair of differential signal pins of FIG. 2.

As seen in FIGS. 1–3, each signal pin 24*a*, 24*b* in a pair 24*p* has an inner side 34*i* that faces toward the other signal pin 24*a*, 24*b* in the pair 24*p*, an outer side 34*o* opposite the inner side 34*i*, a primary side 34*p* that extends between the inner side 34*i* and the outer side 34*o* and that faces toward the primary edge 23 of the base 16, and a non-primary side 34*a* that extends between the inner side 34*i* and the outer side 34*o* and that faces away from the primary edge 23 of the base 16.

Each signal pin 24*a*, 24*b* (and each ground pin 28 as well) as shown in the drawings is generally rectilinear in transverse cross-section, and accordingly the sides 34*a*, 34*o*, 34*p*, 34*a* of each signal pin 24*a*, 24*b* (and the sides of each ground pin 26) are generally flat as shown. However, it will be appreciated that the signal pins 24*a*, 24*b* (and the ground pins 26) can have other configurations in transverse cross-section, including but not limited to circular, oblong, and multi-sides other than four. Nevertheless, the sides 34*a*, 34*o*, 34*p*, 34*a* of each signal pin 24*a*, 24*b* as designated above are still applicable even if such sides do not correspond to flat surfaces in transverse cross-section.

Although the present invention is described in terms of pairs 24*p* of differential signal pins 24*a*, 24*b*, it will be recognized that other arrangements or types of signal pins may be employed without departing from the spirit and scope of the present invention. For example, and depending on the particular application, the signal pins may be individually grouped (in a single-ended arrangement), or may be grouped into threes, fours, fives, etc.

Figure 4:
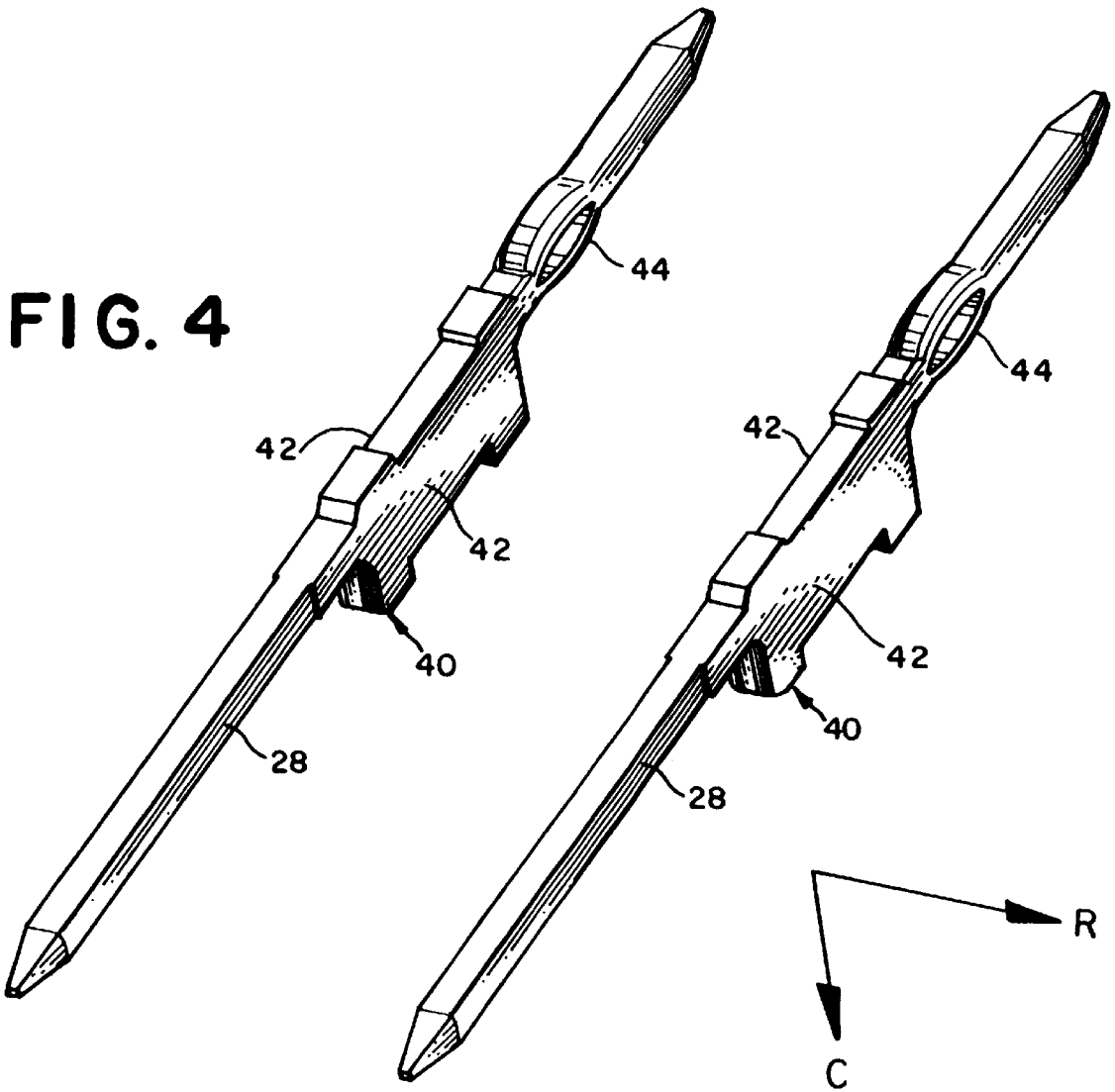
FIG. 4 is the same perspective view of FIG. 2, but shows only the ground pins of FIG. 2.
Figure 5:
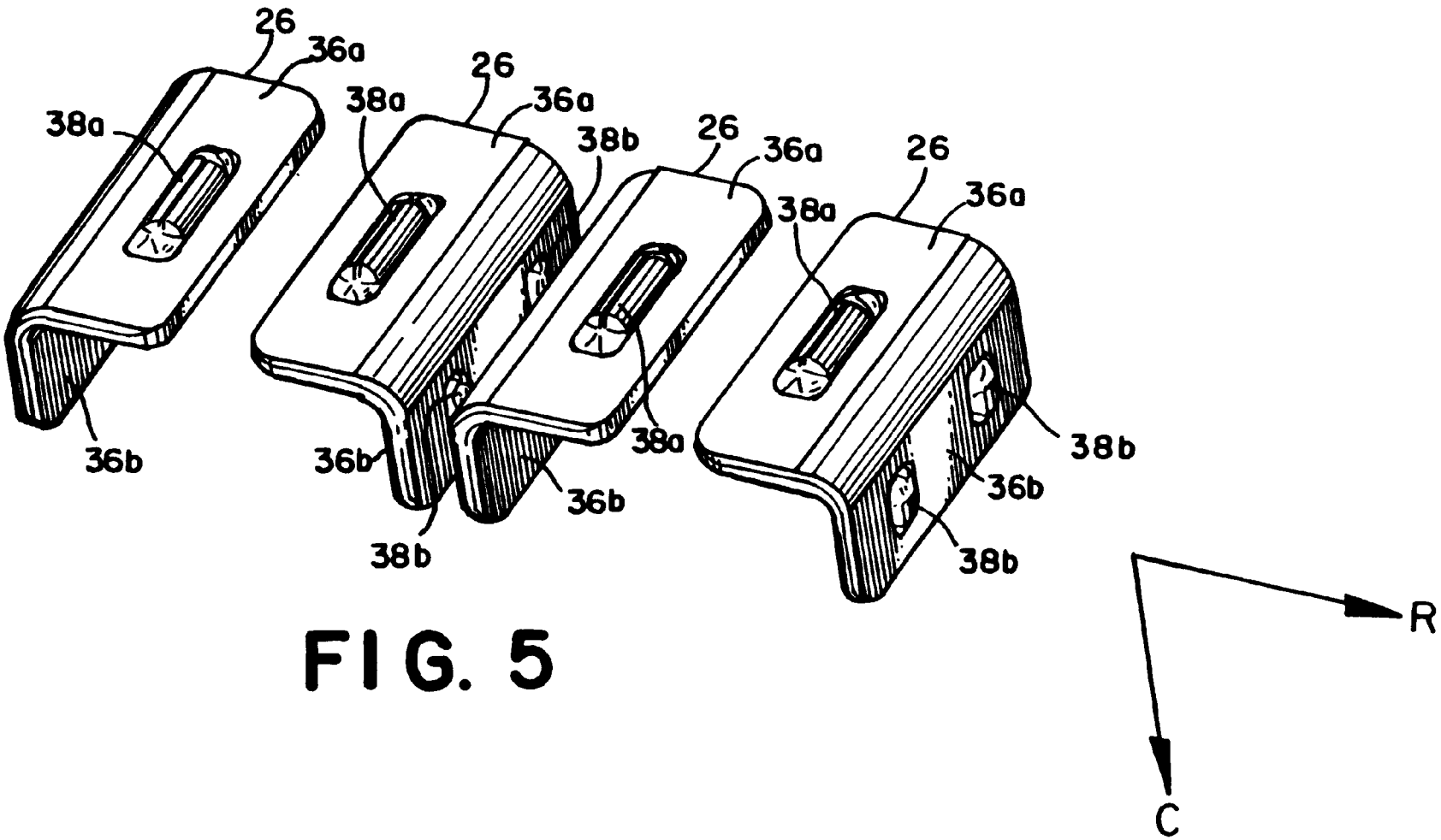
FIG. 5 is the same perspective view of FIG. 2, but shows only the ground shields of FIG. 2.

Referring now to FIGS. 1, 2, and 5, in the embodiment of the header 10 shown, at least one ground shield 26 is associated with each signal pin 24*a*, 24*b*. Preferably, each ground shield 26 generally extends through the base 16 between the connector side 20 and the backplane side 22, and more preferably from about the surface of the connector side 20 to about the surface of the backplane side 22. Accordingly, each ground shield 26 preferably has a depth that generally corresponds to a thickness of the base 16 of the shroud 14. As a result, though not shown in FIGS. 2–5, it should be apparent where the base 16 of the shroud 14 is positioned in relation to the signal pins 24*a*, 24*b*, ground shields 26, and ground pins 28.

Preferably, each ground shield is generally L-shaped and includes first and second attached wings 36*a*, 36*b* that are arranged at about right angles with respect to each other. The first wing 36*a* of each ground shield 26 may extend generally along the first direction (arrow R) adjacent and along the primary side 34*p* or the non-primary side 34*a* of the associated signal pin 24*a*, 24*b*. Of course, to achieve shielding of each pair 24*p* of signal pins 24*a*, 24*b*, it is necessary that some order be provided with regard to which side (primary 34*p* or non-primary 34*a*) each first wing 36*a* extends. As but one example, each ground shield 26 associated with a signal pin 24*a* (to the left in FIG. 1) may extend along the primary side 34*p* thereof, and each ground shield 26 associated with a signal pin 24*b* (to the right in FIG. 1) may extend along the non-primary side 34*a* thereof.

Preferably, the first wings 36*a* of all the ground shields 26 extend adjacent and along one or the other of the primary side 34*p* and the non-primary side 34*i* of the respective associated signal pins 24*a*, 24*b*. As shown, the first wings 36*a* of all the ground shields 26 extend adjacent and along the primary side 34*p* of the respective associated signal pins 24*a*, 24*b*. However, and as was discussed above, in certain circumstances an alternate arrangement may be useful.

As seen in FIGS. 1, 2, and 5, the second wing 36*b* of each ground shield 26 generally extends along the second direction (arrow C) adjacent and along the outside 34*o* of the associated signal pin 24*a*, 24*b*. With the plurality of ground shields 26 thus arranged with respect to the pairs 24*p* of signal pins 24*a*, 24*b*, then, and as best understood by viewing FIG. 1, the plurality of ground shields 26 in combination substantially electromagnetically isolate within the base 16 of the shroud 14 each pair 24*p* of signal pins 24*a*, 24*b* from every other pair 24*p* of signal pin 24*a*, 24*b*.

Preferably, for each pair 24*p* of signal pins 24*a*, 24*b*, the first wings 36*a* of the associated ground shields 26 extend toward each other and reside generally in a single plane. Preferably, such first wings 36*a* do not actually contact each other, and the distal end of each second wing 36*b* does not extend so far as to directly contact another ground shield 26. Accordingly, portions of the material forming the base 16 separate the ground shields 26 from one another, and in doing so provide structurally integrity to such base 16. Due to the lack of direct connections between ground shields 26, and as can be appreciated from FIGS. 1, 2, and 5, unshielded gaps exist between the ground shields. Such gaps should be minimized so that the pairs 24*p* of signal pins 24*a*, 24*b* are adequately shielded.

As shown in FIG. 1, except for the pairs 24*p* in the bottom-most row 30, each pair 24*p* of signal pins 24*a*, 24*b* is substantially surrounded on all sides by ground shields 26. In particular, the outer sides 34*o* and primary sides 34*p* of the signal pins 24*a*, 24*b* are substantially surrounded by the first and second wings 36*a*, 36*b* of the associated ground shields 26, and the non-primary sides 34*a* of the signal pins 24*a*, 24*b* are surrounded by the ground shields 26 associated with the pair 24*p* of signal pin 24*a*, 24*b* immediately below. Since differential pairing is used, shielding between each signal pin 24*a*, 24*b* in each pair 24*p* is not believed to be necessary. If a single-ended arrangement is used, however, shielding between each row of signals may be used. The pairs 24*p* of signal pin 24*a*, 24*b* in the bottom-most row do not have shielding in the direction of the non-primary sides 34*a*. However, no other signal pins 24*a*, 24*b* are in the immediate vicinity in such un-shielded direction to create noise and/or cross-talk in the pairs 24*p* of signal pin 24*a*, 24*b* in the bottom-most row.

Preferably, and as can be seen from FIGS. 1, 2, and 5, each ground shield 26 is generally identical to every other ground shield 26. Moreover, each ground shield 26 is symmetrical such that it can be placed adjacent a signal pin 24*a* or 24*b*. Accordingly, only one type of such ground shield 26 is necessary in constructing the header 10 as shown. As best seen in FIGS. 2 and 5, each ground shield 26 is of a relatively simple design and in fact may be stamped from an appropriate sheet of conductive material into a final form by known forming and/or stamping processes. Alternatively, each shield 26 may be molded or extruded by known processes.

Preferably, the shroud 14 of the header 10 is molded from a suitable insulative material such as a high temperature plastic into a final form by known processes, where such final form includes defined apertures for each signal pin 24*a*, 24*b*, each ground shield 26, and each ground pin 28. Also preferably, each ground shield 26 is inserted into the base 16 of the shroud 14 from either the connector side or backplane side 22, preferably by mechanical means, and such ground shield 26 maintains an interference fit with such base 16 of such shroud 14. Preferably, the first or second wing 36*a*, 36*b* (the first wing 36*a* in FIGS. 2 and 5) of each ground shield 26 includes a bump 38*a* at a surface thereof to assist in maintaining the aforementioned interference fit of the ground shield 26 with the base 16 of the shroud 14.

Alternatively, each signal pin 24*a*, 24*b*, each ground shield 26, and/or each ground pin 28 may be over-molded in situ during formation of the base 16 and shroud 14. However, it is presently believed that such in situ over-molding may be excessively complicated when compared to other available manufacturing techniques.

Preferably, each ground pin 28 electrically contacts at least one ground shield 26 at the second wing 36*b* thereof. More preferably, and as shown in FIGS. 1 and 2, such contact occurs at the outer surface (the surface away from the associated signal pin 24*a*, 24*b*) of such second wing 36*b*. Preferably, every ground shield 26 electrically contacts a ground pin 28. Presumably, at some location, either in the complementary electrical connector, the mother board, or in another circuit, each ground pin 28 is electrically grounded. Accordingly, the ground shields 26 electrically contacted by the ground pins 28 are also grounded and are electrically coupled to one another. Although described up to now as rigid bumps 38*a*, 38*b*, other types of retention features may be employed without departing from the spirit and scope of the present invention. For example, one or both wings 36*a*, 36*b* in each ground shield 26 could include a compliant section (not shown) to retain such ground shield 26 in the base 16 of the shroud 14 and/or to retain an associated ground pin 28 in such base 16 of such shroud 14.

Preferably, and as best seen in FIGS. 2 and 4, each ground pin 28 includes a generally planar fin 40 that generally resides within the base 16 of the shroud 14 and that extends generally laterally from the main body of the ground pin 28. As seen in FIG. 1, the fin 40 extends generally in the second direction (arrow C), and has generally opposing planar sides 42 (FIGS. 2, 4). Accordingly, each ground shield 26 is electrically contacted by a ground pin 28 at a planar side 42 of the fin 40 of such ground pin 28.

Preferably, the ground pins 28 are arranged into a plurality of rows 30 that extend in the first direction (arrow R), and a plurality of columns 32*be*, 32*bi* that extend in the second direction (arrow C). As seen in FIG. 1, each row 30 of ground pins 28 corresponds to a row 30 of signal pin 24*a*, 24*b*, and each column 32*be*, 32*bi* of ground pins 28 alternates with a column 32*a* of pairs 24*p* of signal pins 24*a*, 24*b*. As seen, columns 32*be* of ground pins 28 are a pair of exterior or outer-most columns (left and right) and columns 32*bi* of ground pins 28 are at least one interior column (four are shown in FIG. 1) positioned between such exterior columns 32*be*. Preferably, each ground pin 28 in each interior column 32*bi* is positioned between and electrically contacts first and second ground shields 26 on either lateral side of such ground pin 28. As will be described below, each ground pin 28 in each interior column 32*bi* preferably contacts bumps 38*b* on wings 36*b* of such first and second ground shields 26. Also preferably, each ground pin 28 in each exterior column 32*be* is positioned adjacent and electrically contacts only a single ground shield 26 on one lateral side thereof.

In the case of a ground pin 28 in one of the interior columns 32*bi*, it is seen from FIG. 1 that the first ground shield 26 corresponding to such ground pin 28 is associated with a signal pin 24*a*, 24*b* of a first pair 24*p* of signal pins on one side of the ground pin 28 (the left side, for example), the second ground shield 26 is associated with a signal pin 24*a*, 24*b* of a second pair 24*p* of signal pin 24*a*, 24*b* on the other side of the ground pin 28 (the right side, to continue the example), and the first and second ground shields 26 electrically contact the ground pin 28 at either planar side of the fin 40 thereof. As seen, then, the first and second pairs 24*p* of signal pins 24*a*, 24*b* both reside in a row 30 that corresponds to the row 30 of the ground pin 28 at issue; more precisely, such ground pin 28 and such first and second pairs 24*p* of signal pin 24*a*, 24*b* can be considered to reside in a single row 30 (although not necessarily linearly aligned within the row 30). As also seen, such first and second pairs 24*p* of signal pins 24*a*, 24*b* respectively reside in immediately adjacent columns 32*a* on either side of the column 32*bi* of the ground pin 28 at issue.

In the case of a ground pin 28 in one of the exterior columns 32*be*, it is also seen from FIG. 1 that the single ground shield 26 corresponding to such ground pin 28 is associated with a signal pin 24*a*, 24*b* of a single pair 24*p* of signal pins on one side of such ground pin 28, and the single ground shield 26 electrically contacts the ground pin 28 at one planar side of the fin 40 thereof. Similar to the previous case, the single pair 24*p* of signal pins 24*a*, 24*b* resides in a row 30 corresponding to the row 30 of such ground pin 28. In this case, the single pair 24*p* of signal pins 24*a*, 24*b* resides in an immediately adjacent column 32*a* on only one side of the column 32*be* of such ground pin 28.

In either case, each ground pin 28 is preferably inserted into the base 16 of the shroud 14 from either the connector side or backplane side 20, 22 thereof, as with the ground shields 26. Such operation may be performed by appropriate automatic insertion machinery. Preferably, each ground pin 28 in the interior columns 32*bi* maintains an interference fit between contacted second wings 36*b* of the first and second ground shields 26, and more preferably between contacted bumps 38*b* on such second wings 36*b*. Correspondingly, it is preferable that each ground pin 28 in the exterior columns 32*be* maintains an interference fit between the contacted second wing 36*b* of the single ground shield 26 and with an interior surface of the base 16 (not shown) where such interior surface is opposite the contacted second wing 36*b* of the single ground shield 26. Preferably, and as best seen in FIGS. 2 and 5, each second wing 36*b* of each ground shield 26 includes a bump or bumps 38*b* at a contact surface thereof (the outer surface as shown in FIGS. 1, 2, and 5) to assist in electrically contacting the ground pin 28 at the fin 40 thereof, and to assist in maintaining the aforementioned interference fit.

As with the ground pins 28 and ground shields 26, each signal pin 24*a*, 24*b* is preferably inserted into the base 16 of the shroud 14 from either the connector side or backplane side 20, 22 thereof, and preferably maintains an interference fit with such base 16. Such insertion operation may be performed by appropriate automatic insertion machinery. More preferably, all of the aforementioned elements are inserted into the base 16 of the shroud 14 from the backplane side 22. As should be understood, the backplane side 22 is more readily accessible since it is not obstructed by any walls 18. Moreover, insertion from the backplane side 22 locks pins 24*a*, 24*b*, 28 in place upon securing the header 10 to the backplane 12. Preferably, and as seen in FIGS. 2 through 4, each signal pin 24*a*, 24*b* and each ground pin 28 preferably includes various contact surfaces that assist in maintaining an interference fit directly with the base 16 of the shroud 14.

Preferably, each signal pin 24*a*, 24*b* and each ground pin 28 includes a compliant section 44 exterior from the base 16 adjacent the backplane side 22 thereof, as best seen in FIGS. 2–4. As should be understood, each compliant section 44 maintains an interference fit with plated through holes in the backplane 12 when the header 10 is mounted thereto. As should be appreciated, it is undesirable to insert the compliant sections 44 into the base 16 of the shroud 14. Such compliant portions 44 may deform or likely would not easily fit through such base 16 during such insertion.

In one embodiment of the header 10, and referring again to FIG. 1, each signal pin 24*a*, 24*b* and each ground pin 28 in transverse cross-section is approximately 0.4 mm by 0.4 mm in width and height, in the region of the main pin portions that are received by the complementary electrical connector. Additionally, in such embodiment, each ground shield 26 has a main thickness of about 0.2 mm. Accordingly, if each signal pin 24*a*, 24*b* and each ground pin 28 in a row 30 is spaced about 1.0 mm in the first direction (arrow R), each signal pin 24*a*, 24*b* may be separated from its corresponding ground shield 26 by about 0.4 mm. Such distance is sufficient to provide a reasonable degree of structural integrity to the base 16 of the shroud 14.

Figure 6:
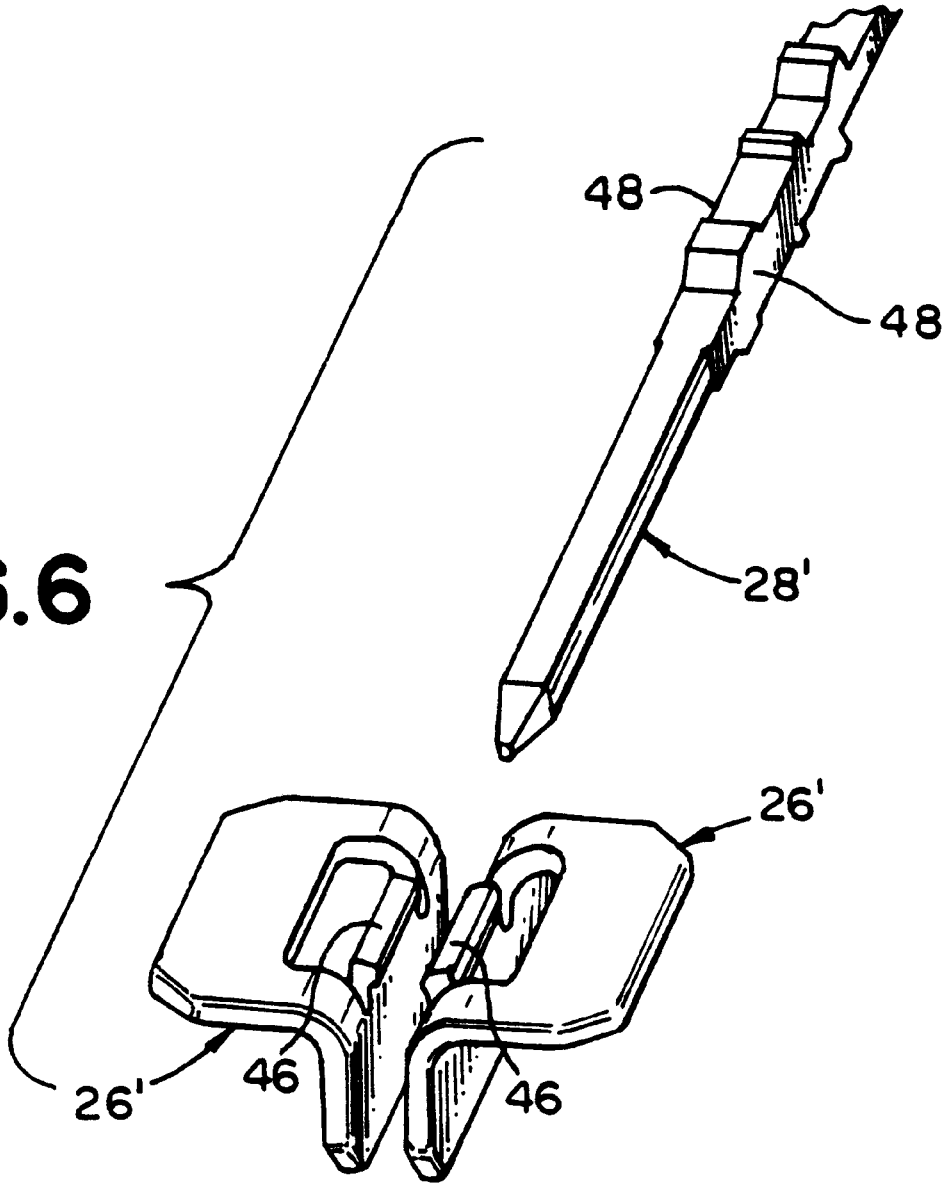
FIG. 6 is a perspective view showing a ground pin and a pair of ground shields in accordance with an alternate embodiment of a header.

Referring now to FIG. 6, it is seen that in an alternate embodiment of the header 10, each ground pin 28' does not have the fin 40 of the ground pin 28 (FIGS. 2 and 4), and each ground shield 26' does not have the contacting bump(s) 38*b* of the ground shield 26 (FIGS. 2 and 5). Instead, each ground shield 26' includes an integral tab 46 that contacts a contact portion 48 of the ground pin 28', where the contact portion 48 is generally in-line with respect to the longitudinally extending ground pin 28'. Preferably, the tab 46 is formed within the ground shield 26' by an appropriate stamping or molding operation, and the tab 46 is inclined slightly away from the main body of the ground shield 26' and toward the ground pin 28'. Accordingly, the tab 46 is urged into good electrical contact with the contact portion 48 when the ground pin 28' and the ground shield 26' are mounted to the base 16 of the shroud 14 (not shown in FIG. 6). As shown, the ground pin 28' is for an interior column 32*bi* since two ground shields 26' flank such ground pin 28'. Of course, only one ground shield 26' would flank the ground pin 28' if such ground pin 28' were in an exterior column 32*be*.

Figure 7:
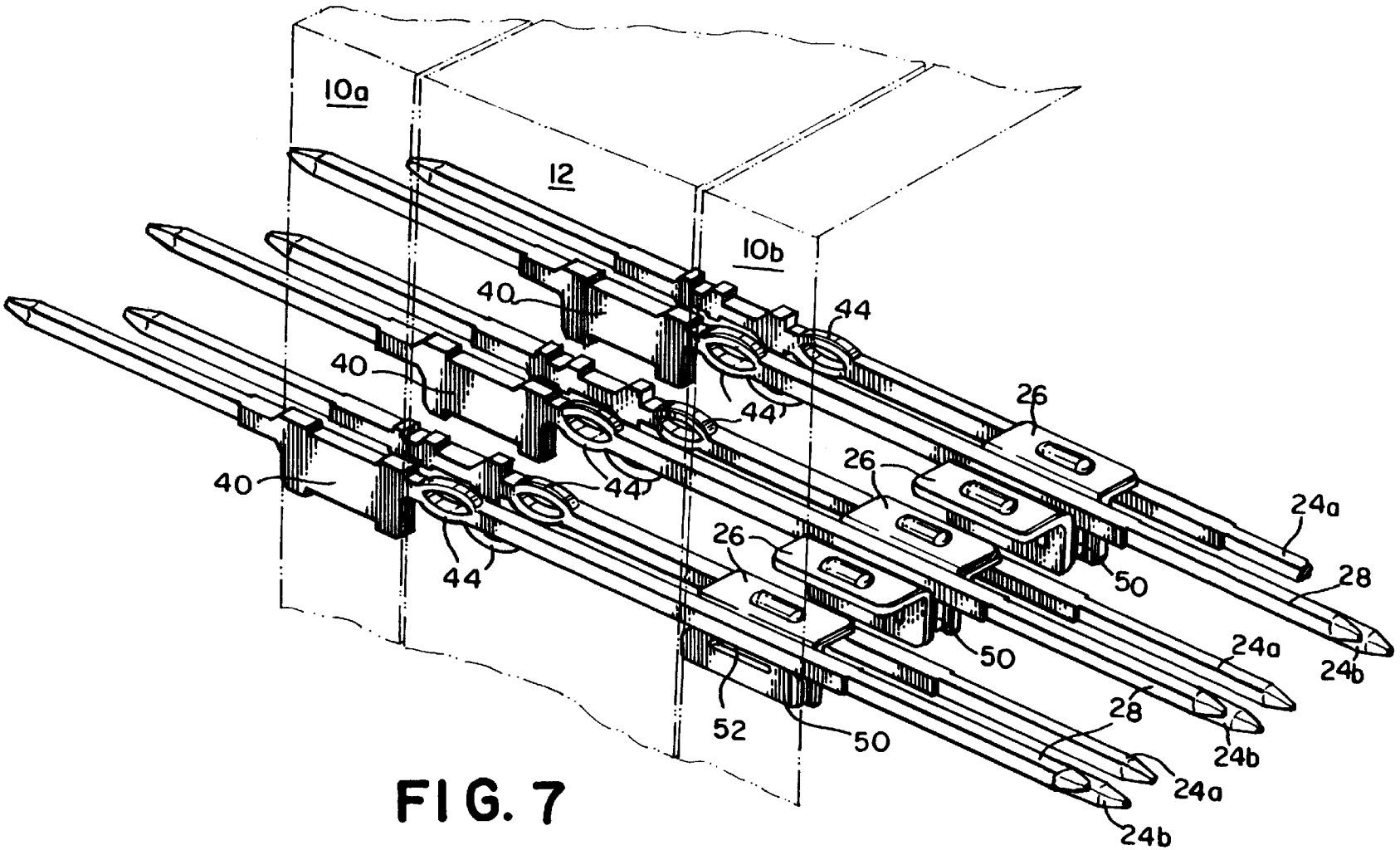
FIG. 7 is a perspective view similar to that of FIG. 2, but from a different angle, and shows another embodiment of a header which is similar to the embodiment as shown in FIGS. 1–5, wherein primary and secondary headers share common pins and sandwich the backplane therebetween.

Referring now to FIG. 7, it is seen that in another embodiment of the header 10 which is similar to the embodiment as shown in FIGS. 1–5, a primary header 10*a* has pairs 24*p* of signal pins 24*a*, 24*b* and ground pins 28 that extend a relatively longer distance (as compared with the header 10 of FIGS. 1–5) beyond the backplane 12 than the header 10 shown in FIGS. 1–5. In addition, a secondary header 10*b* is positioned on the other side of the backplane 12 and generally opposite the primary header 10*a* such that the secondary header 10*b* receives and includes the extended portions of the pairs 24*p* of signal pins 24*a*, 24*b*. Accordingly, the backplane 12 is sandwiched between the primary and secondary headers 10*a*, 10*b*, each header 10*a*, 10*b* shares the pairs 24*p* of signal pins 24*a*, 24*b* and the ground pins 28, and a circuit board mounted to the primary header 10*a* is directly interfaced through the backplane 12 to another circuit board mounted to the secondary header 10*b*. Each header 10*a*, 10*b* has its own ground shields 26 (the ground shields 26 for the primary header 10*a* are not shown in FIG. 7). Unlike the primary header 10*a*, the secondary header 10*b* includes a plurality of securing contacts 50, where each securing contact 50 electrically contacts a respective ground pin 28 and secures such ground pin 28 to such header 10*b*. As seen, each securing contact 50 also electrically contacts at least one ground shield 26 within the secondary header 10*b* through bumps 38*b*, thereby electrically connecting the contacted ground shield(s) 26 with the contacted ground pin 28.

In particular, the primary header 10*a* of FIG. 7 is substantially identical to the header 10 of FIGS. 1–5, except that the pairs 24*p* of signal pins 24*a*, 24*b* and ground pins 28 extend a relatively longer distance as compared with the header 10 of FIGS. 1–5 to allow for rear plug-up. For example, in the header 10 of FIGS. 1–5, such pins 24*a*, 24*b*, 28 extend about 4.3 mm through and beyond the backplane 12, while in the primary header 10*a* of FIG. 7, such pins 24*a*, 24*b*, 28 extend about 19 mm through and beyond the backplane 12.

Preferably, each pin 24*a*, 24*b*, 28 is formed such that the distal end thereof (i.e., the end associated with the secondary header 10*b*) is substantially identical to the proximal end thereof (i.e., the end associated with the primary header 10*a*). Accordingly, the secondary header 10*b* is instantiated by way of a second shroud 14 substantially identical to the shroud 14 of the primary header 10*a*, where the second shroud 14 is slipped over the distal end of each pin 24*a*, 24*b*, 28 (FIG. 7A) after such pins are inserted through the backplane 12. As should be understood, the second shroud 14 is then moved toward the backplane 12 until the base 16 of such second shroud 14 is generally parallel to and in contact with such backplane 12. As viewed from their respective connector sides 20, then, the primary header 10*a* and the secondary header 10*b* each present substantially the same profile, pin arrangement, and 'footprint'. In fact, it is preferable that the primary header 10*a* and the secondary header 10*b* each be able to receive the same type of complementary electrical connector in their respective wells. Preferably, the primary edge 23 of the secondary header 10*b* is directly opposite the primary edge 23 of the primary header 10*a*, with respect to the backplane 12.

As was discussed above, and as similarly shown in FIGS. 2 and 4, each ground pin 28 in the primary header 10*a* includes a generally planar fin 40 that generally resides within the base 16 of the shroud 14 of the primary header 10*a* and that extends generally laterally from the main body of the ground pin 28. As seen, each fin 40 has generally opposing planar sides such that each ground shield 26 in the primary header 10*a* is electrically contacted by a ground pin 28 at a planar side of the fin 40 of such ground pin 28. As was also discussed above, each ground pin 28 is preferably inserted into the shroud 14 of the primary header 10*a* such that the fin 40 maintains an interference fit therewith.

However, and as should be understood, the insertion of each ground pin 28 through the backplane 12 prevents such ground pin 28 from having a second fin on the distal end thereof. Accordingly, and as was discussed above, it is preferable that the secondary header 10*b* include a plurality of securing contacts 50, where each securing contact 50 contacts a respective ground pin 28, secures such ground pin 28 to such header 10*b*, electrically connects such ground pin 28 to at least one ground shield 26 (through bumps 38*b*), and in effect performs the same function as a fin 40.

Figure 7B:
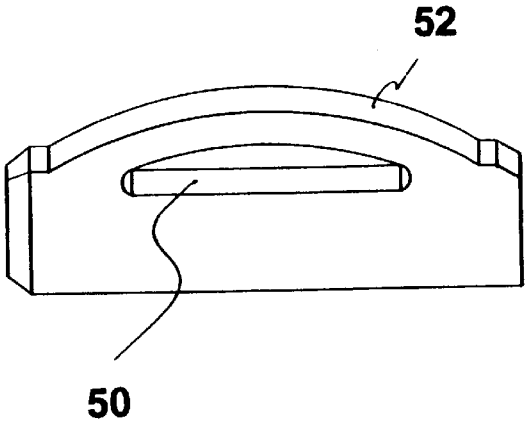
FIG. 7B is a perspective view showing a securing contact employed in connection with the secondary header of FIG. 7.
Figure 7A:
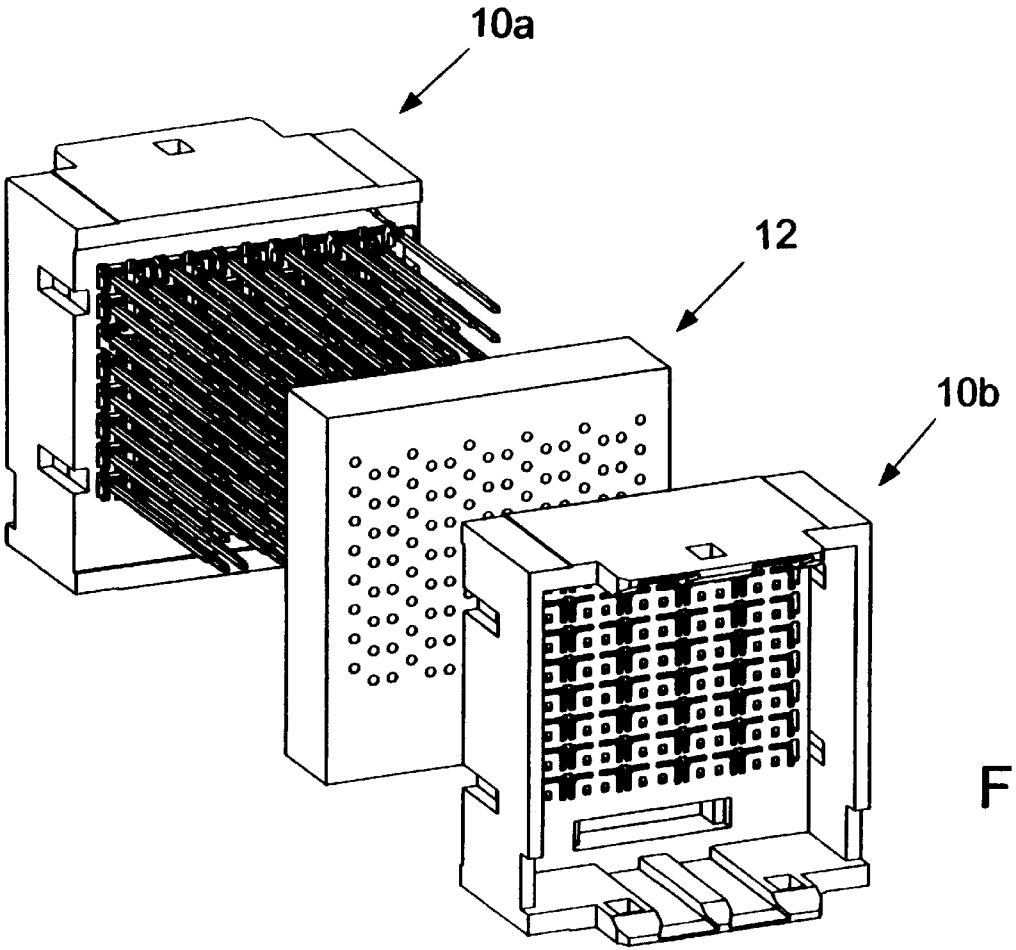
FIG. 7A is an exploded perspective view showing the primary header, backplane, and secondary header of FIG. 7.

In particular, it is preferable that, prior to being mounted to the backplane 12 and the pins 24*a*, 24*b*, 28, the second shroud 14 be fitted with a plurality of conductive securing contacts 50, where one contact 50 is in each space in the base 16 of the second shroud 14 where a second fin of a ground pin 28 would otherwise reside. The insertion of contacts 50 is generally similar to the insertion of shields 26 into the base 16. As seen in FIG. 7B, each such securing contact 50 has generally opposing planar sides, and as positioned in the second shroud 14 of the secondary header 10*b* is electrically contacted on at least one side by a ground shield 26 in the secondary header 10*a* at a planar side of such securing contact 50.

When the second shroud 14 is slipped over the distal end of each pin 24*a*, 24*b*, 28 and moved toward the backplane 12, then, each securing contact 50 in such second shroud 14 securingly electrically contacts the side of a respective ground pin 28 and maintains an interference fit therewith. Preferably, each securing contact 50 includes a compliant or spring portion 52 in facing relation to the side of the respective ground pin 28 to assist in securingly electrically contacting the respective ground pin 28 and maintaining the interference fit therewith. As with the fin 40, each securing contact 50 engages bumps 38*b* on the contacted-to ground shields 26. However, any other appropriate mechanism may be employed to perform such functions without departing from the spirit and scope of the present invention.

With such securing contacts 50, the ground shields 26 in the second shroud 14 are electrically coupled to the ground pins 28. In addition, the entire second shroud 14 is secured to the backplane 12. The interference fit between the securing contacts 50 and the ground pins 28 secures the second shroud 14 to the backplane 12.

The header 10 and its variations as discussed above have proven to be remarkably capable of reducing noise and/or cross-talk. However, the particular design of such header 10 and its variations may not accommodate parts having relatively large dimensional variations.

In particular, and as was discussed above, each ground pin 28, each ground shield 26, and each signal pin 24*a*, 24*b* is inserted into the base 16 of the shroud 14 and is held in place by an interference fit. Specifically, each ground pin 28 in the interior columns 32*bi* maintains an interference fit between contacted bumps 38*b* on flanking ground shields 26, each ground pin 28 in the exterior columns 32*be* maintains an interference fit between a bump 38*b* at an adjacent ground shield 26 and with an interior surface of the base 16 (not shown), and each ground shield 26 also includes a bump 38*a* at a surface thereof to assist in maintaining an interference fit of such ground shield 26 directly with the base 16 of the shroud 14. Of course, each signal pin 24*a*, 24*b* also maintains an interference fit with such base 16.

Of particular interest here is the bumps 38*a*, 38*b* on the ground shields 26, which have heretofore been shown and described as rigid. Being rigid, such bumps 38*a*, 38*b* afford little flexibility and therefore can fail to in fact effectuate the aforementioned interference fits if housing 12, shields 26, or pins 24 are not dimensionally precise. That is, if an aperture in the header base 16 is slightly too wide, or if an interfacing bump 38*a*, 38*b* on an inserted ground shield 26 is slightly too short, such rigid bump 38*a*, 38*b* with little if any 'give' does not contact its intended contact point within such aperture, does not contact a ground pin 28 (if a bump 38*b*), and does not help to hold the ground shield 26 within the aperture by way of an interference fit. As a result, such ground shield 26 intermittently or entirely out of contact with a ground pin 28 (if a bump 38*b*) may fail to properly electrically shield, and can fall out of the base 16. Conversely, if an aperture in the header base 16 is slightly too narrow, or if a bump 38*a*, 38*b* on an inserted ground shield 26 is slightly too tall, such bump 38*a*, 38*b* may cause excessive strain within the base 16 which can lead to immediate or eventual structural failure. As a result, the header 10 could be damaged or destroyed.

The aforementioned predicament is at least partially resolved by converting at least one of the rigid bumps 38*a*, 38*b* into a relatively flexible bump. In particular, and in one embodiment of the present invention, and referring now to FIGS. 8 and 9, a modified ground shield 60 is introduced in place of the ground shield 26 of FIGS. 1–7. Such ground shield 60 is generally planar and extends generally in the first direction (as indicated by the arrow R) along the base 16 and above a corresponding signal pin 24*a*, 24*b*, and therefore does not have the wings 36*a*, 36*b* of the ground shield 26. Accordingly, the fin 40 of the ground pin 28 is relied upon to provide shielding in the second direction (as indicated by the arrow C in FIGS. 1–7) along the base 16.

Importantly, each ground shield 60 contacts a corresponding ground pin 28 by way of a flexible bump 62, where such flexibility is achieved by placing the bump 62 at a distal end of a cantilevered beam 64 that extends out from the ground shield 60 at a lateral side thereof adjacent a contacted-to ground pin 28. It is to be appreciated, that mechanisms other than the beam 64 may be employed to impart flexibility to the bump 62 without departing from the spirit and scope of the present invention.

Figure 8:
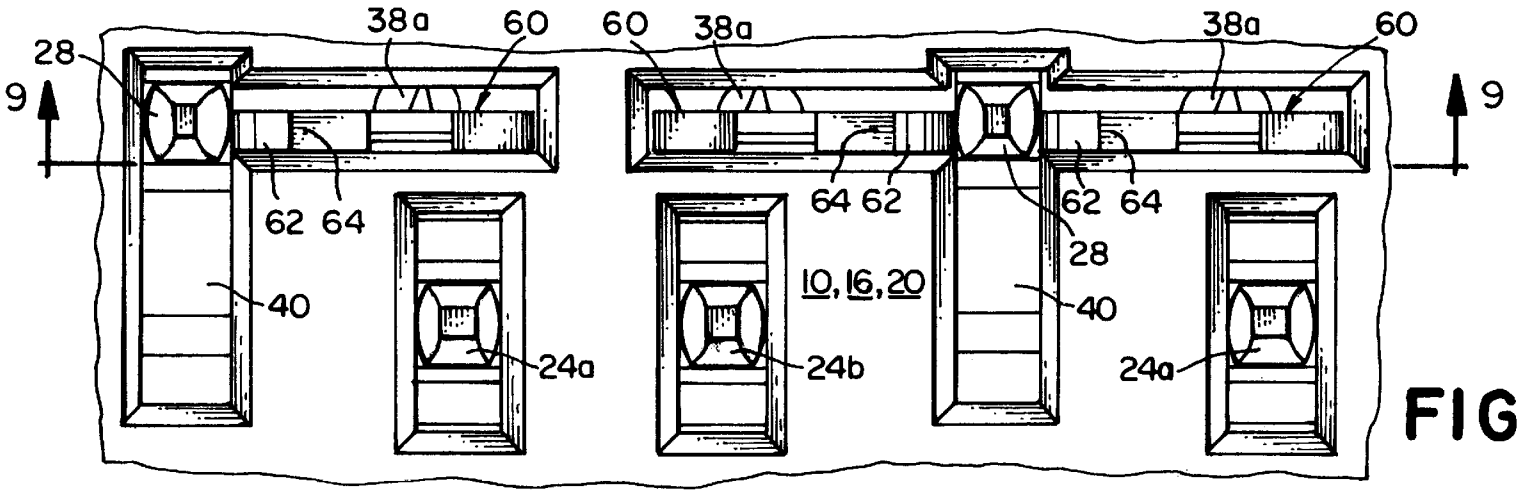
FIG. 8 is a plan view of a portion of the connector side of a header similar to the header of FIG. 1 in accordance with an embodiment of the present invention.
Figure 9:
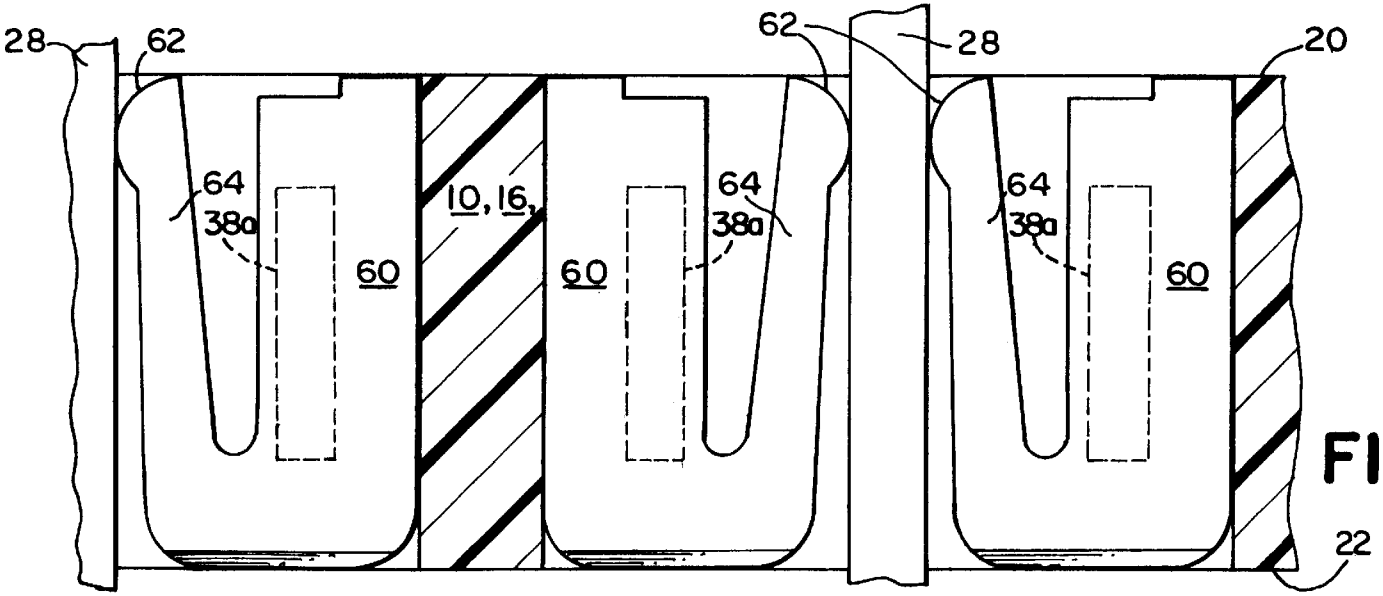
FIG. 9 is a cross-sectional view taken along the line 9—9 of FIG. 8, and shows the grounds shields of the header of FIG. 8.

As may be appreciated from FIGS. 8 and 9, such beam 64 resides in and cantilevers within the general plane of the ground shield 60. As may also be appreciated, the cantilevered beam 64 is sufficiently flexible so as not to deform permanently within the aperture space provided for the ground shield 60 when such ground shield 60 is inserted thereinto. Nevertheless, the beam 64 is sufficiently rigid so that the bump 62 at the end thereof provides adequate force against the ground shield 60 to maintain an interference fit in the first direction within such aperture space and contact the contacted-to ground pin 28 even if such aperture space is somewhat tight or loose in the first direction. As a result, the ground shield 60 allows for a relatively wide variation in the dimensions of the housing 12, shield 60 and pins 24 in the first direction in the aperture space within which such ground shield 60 is received. Note that while the cantilevered beam 64 introduces an unshielded gap to the ground shield 60, such gap is believed to allow merely an insubstantial amount of cross-talk and/or noise to pass therethrough.

As shown in FIGS. 8 and 9, adjacent ground shields 60 (i.e., those flanking a corresponding ground pin 28 or those between adjacent ground pins 28 in the first direction) are generally complementary or mirror-image in design, especially when additional features of the ground shields 60 (discussed below) on the planar sides of the ground shields 60 are taken into account. Nevertheless, it is believed that generally identical ground shields 60 may be adjacent one another without departing from the spirit and scope of the present invention as long as the bumps 62 thereof are in contact with corresponding ground pins 28. In such case, adjacent ground shields 60 would not appear to be mirror-images of each other, which although aesthetically suspect is not believed to detract from the functional aspects of the ground shields 60.

As also seen in FIGS. 8 and 9, each ground shield 60 has the relatively rigid bump 38*a* of the ground shield 26. Accordingly, such ground shield 60 does not necessarily maintain an interference fit within the aperture space provided for the ground shield 60 if such aperture space is relatively loose in the second direction. Likewise, such ground shield 60 may exert excessive force within the aperture space provided for the ground shield 60 if such aperture space is relatively tight in the second direction. As a result, the ground shield 60 does not necessarily allow for a relatively high tolerance in the margin of error in the second direction in the aperture space within which such ground shield 60 is received.

Figure 10:
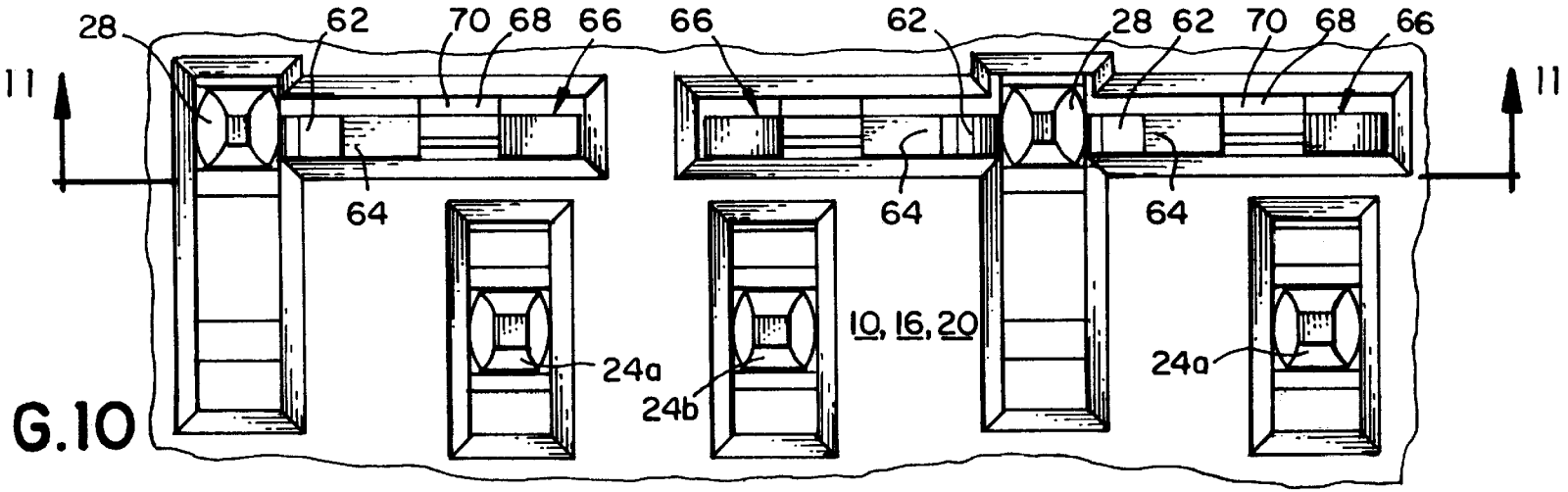
FIG. 10 is a plan view of a portion of the connector side of a header similar to the header of FIG. 1 in accordance with another embodiment of the present invention.
Figure 11:
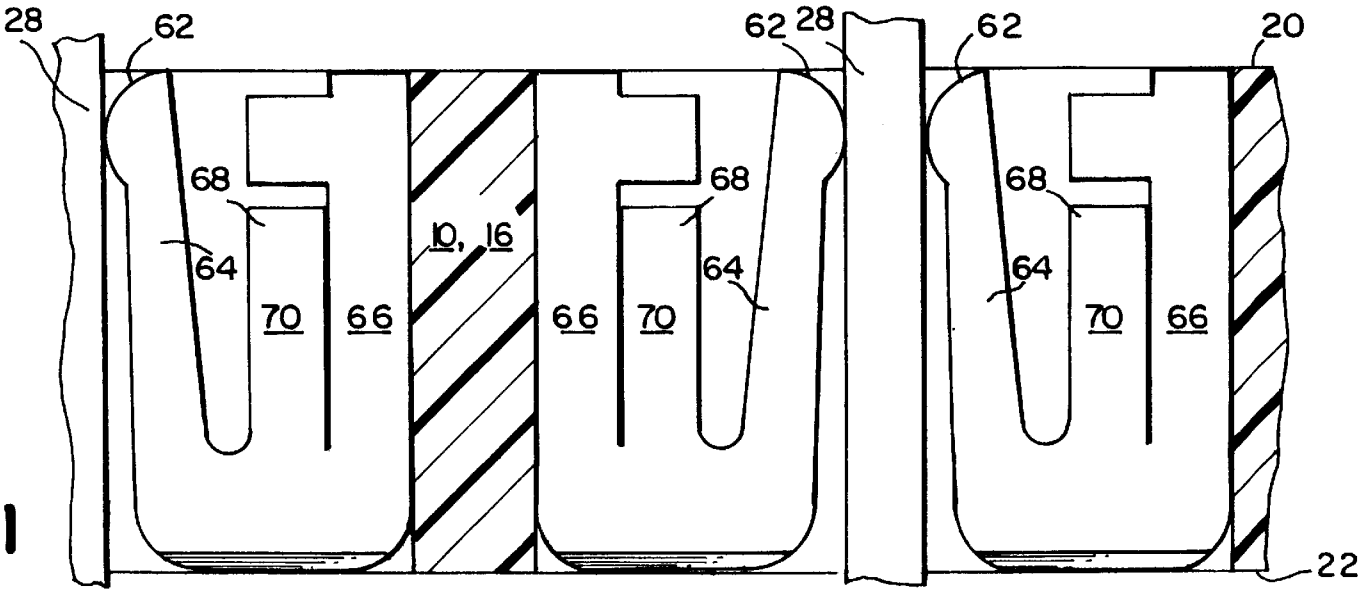
FIG. 11 is a cross-sectional view taken along the line 11—11 of FIG. 10, and shows the grounds shields of the header of FIG. 10.

In one embodiment of the present invention, then, and referring now to FIGS. 10 and 11, an additionally modified ground shield 66 is introduced in place of the ground shield 60 of FIGS. 8 and 9. Such ground shield 66 is also generally planar and extends generally in the first direction (as indicated by the arrow R) along the base 16 and above a corresponding signal pin 24*a*, 24*b*, and has the bump 62, cantilevered beam 64, and interference fit in the first direction of the ground shield 60.

Importantly, each ground shield 66 contacts an inner wall of the aperture space within which the ground shield 66 resides by way of a flexible bump 68, where such flexibility is achieved by placing the bump 68 at a distal end of a cantilevered beam 70 that extends out from the ground shield 60 at a planar side thereof. In fact, the bump 68 need not necessarily be a protrusion or the like on the beam 70, but may instead merely be the distal tip or end of the beam 70. It is to be appreciated that mechanisms other than the beam 70 may be employed to impart flexibility to the bump 68 without departing from the spirit and scope of the present invention.

As may be appreciated from FIGS. 10 and 11, such beam 70 extends outside of and cantilevers away from the general plane of the ground shield 66. As with the beam 64, the cantilevered beam 64 is not so flexible as to deform within the aperture space provided for the ground shield 66 when such ground shield 66 is inserted thereinto. Nevertheless, the beam 70 is flexible enough so that the bump 68 at the end thereof allows the ground shield 66 to maintain an interference fit within such aperture space in the second direction and contact the opposing inner walls of the aperture space even if such aperture space is somewhat tight or loose in the second direction. As a result, the ground shield 66 with the bump 68 at the end of the beam 70 allows for a relatively high tolerance in the margin of error in the second direction in the aperture space within which such ground shield 60 is received. Moreover, such ground shield 66 with the bump 62 at the end of the beam 64 also allows for a relatively high tolerance in the margin of error in the first direction in such aperture space.

As shown in FIGS. 10 and 11, and as with adjacent ground shields 60, adjacent ground shields 66 (i.e., those flanking a corresponding ground pin 28 or those between adjacent ground pins 28 in the first direction) are generally complementary or mirror-image in design, especially when the bumps 68 and beams thereof are taken into account. Nevertheless, it is believed that generally identical ground shields 66 may be adjacent one another without departing from the spirit and scope of the present invention as long as the bumps 62 thereof are in contact with corresponding ground pins 28 and the bumps 68 thereof each contact one of the opposing inner walls of the aperture space within which the ground shields 66 reside. Once again, in such case, adjacent ground shields 66 would not appear to be mirror-images of each other, which although aesthetically suspect is not believed to detract from the functional aspects of the ground shields 66.

In the headers 10 shown in FIGS. 1–11, each ground shield 26, 60, 66 generally extends through the base 16 between the connector side 20 and the backplane side 22, and more preferably from about the surface of the connector side 20 to about the surface of the backplane side 22. Accordingly, each ground shield 26 preferably has a depth that generally corresponds to a thickness of the base 16 of the shroud 14. Moreover, in such headers 10, adjacent ground shields 26, 60, 66 between adjacent ground pins 28 do not actually contact each other. Accordingly, portions of the material forming the base 16 separate such ground shields 26, 60, 66 from one another, and in doing so provide structurally integrity to such base 16. However, such portions also define unshielded gaps between the ground shields 26, 60, 66, and such gaps may allow noise and cross-talk to pass through.

Figure 12:
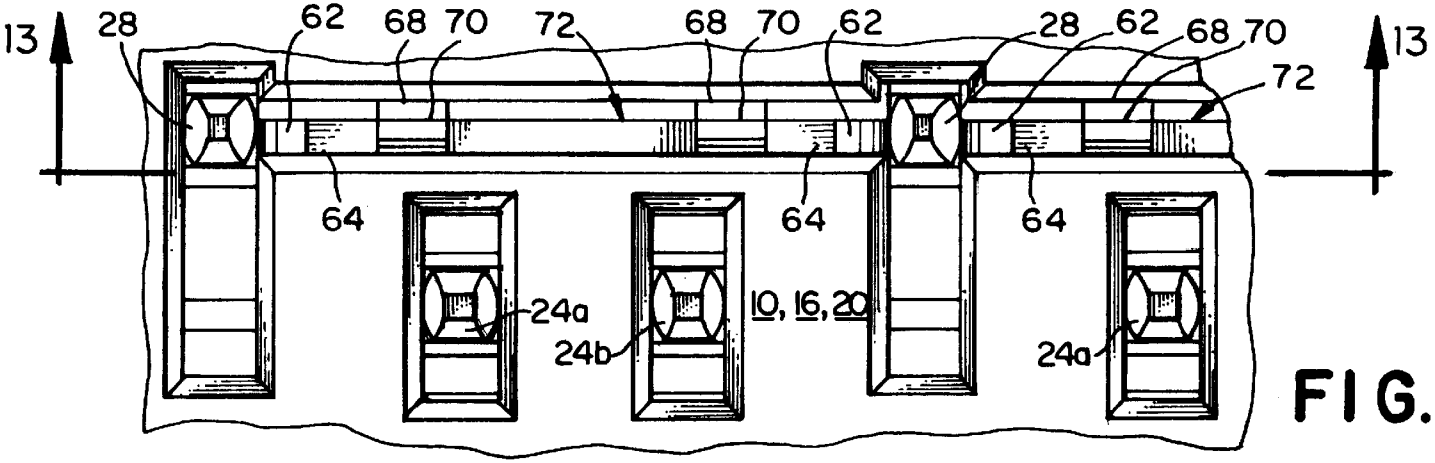
FIG. 12 is a plan view of a portion of the connector side of a header similar to the header of FIG. 1 in accordance with still another embodiment of the present invention.
Figure 13:
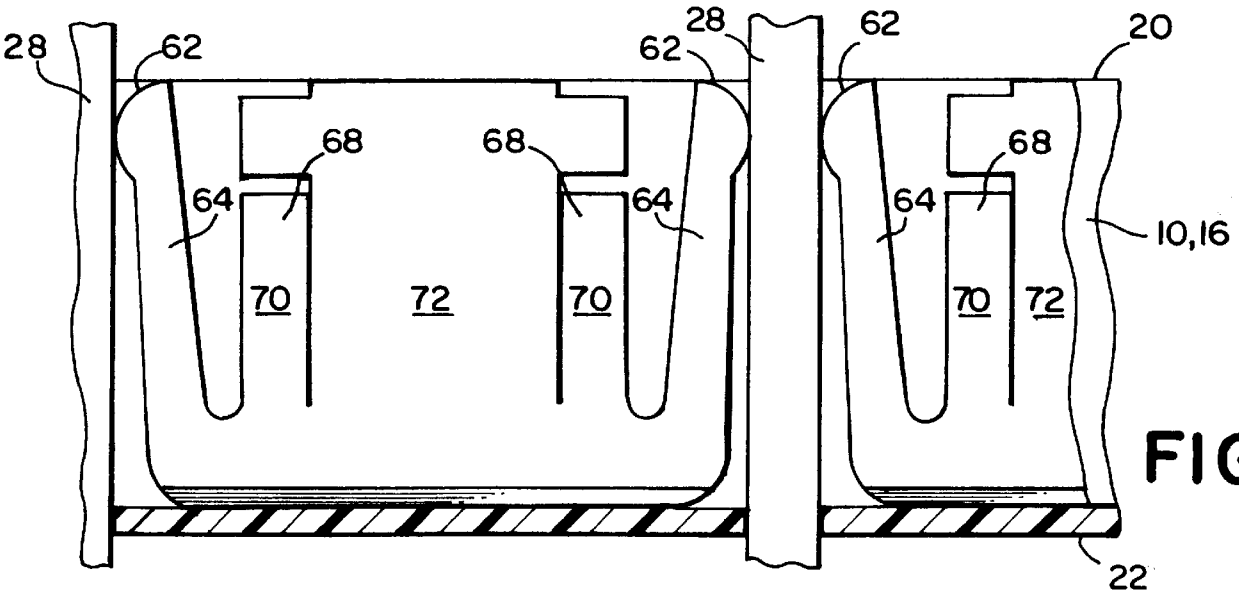
FIG. 13 is a cross-sectional view taken along the line 13—13 of FIG. 12 and shows the grounds shields of the header of FIG. 12.

In one embodiment of the present invention, then, and referring now to FIGS. 12 and 13, a further modified ground shield 72 is introduced in place of adjacent pairs of ground shields 66 of FIGS. 10 and 11. Such ground shield 72 is also generally planar and extends generally in the first direction (as indicated by the arrow R) along the base 16. Here, the ground shield 72 is positioned above a corresponding pair 24*p* of signal pins 24*a*, 24*b*, and exhibits no gap such as that in connection with ground shields 26, 60, 66. Thus, no gap-related noise and cross-talk is experienced. Moreover, and as should be understood, replacing pairs of ground shields with a single ground shield 72 reduces the number of ground shields and the ground shield insertion time during manufacturing of the header 10 approximately in half.

As may be appreciated from FIG. 12 in particular, at least at the connector side 20 of the base 16, the aperture that receives the ground shields 72 and ground pins 28 stretches generally continuously between lateral sides (i.e., left to right) of the base 16. Accordingly, no portion of the material forming such base 16 bridges across such aperture (i.e., top to bottom) and assists in providing structurally integrity to such base 16. To provide such structural integrity in the present embodiment, then, such aperture does not in fact extend entirely through the housing 12 between the connector side 20 and the backplane side 22.

Instead, and as seen in FIG. 13, such aperture extends from the connector side 20 and stops short of the backplane side 22 in regions where the ground shields 72 are inserted. Thus, the portion of the material forming such base 16 that is not removed at the backplane side 22 assists in positioning the shield 72 properly within the housing 12 and in providing structurally integrity to such base 16. Consistent with the stop-short aperture, then, and as also seen in FIG. 13, each ground shield 72 as inserted also extends from the connector side 20 and stops short of the backplane side 22. Put another way, each ground shield 72 has a depth that is less than a thickness of the base 16 of the shroud 14.

As a result, the ground shield 72 does not shield within the entirety of the base 16 from the connector side 20 to the backplane side 22 thereof, but from the connector side 20 to the stop-short point adjacent the backplane side 22. As before, such non-shielded areas may allow noise and cross-talk to pass through, although it is presently believed that such pass-through noise and cross-talk is minimal and in any event less than that in connection with the headers 10 of FIGS. 1–11. Moreover, in the case where the base 16 is molded from a suitable insulative material such as a high temperature plastic, the portion of the material forming the base 16 that is not removed at the backplane side 22 as represented within a mold allows plastic to flow relatively freely within such mold. As should be appreciated, this is especially true as compared with a mold for the base 16 of the header 10 of FIGS. 1–11. As should also be appreciated, free flow contributes substantially to avoiding voids and the like within the base 16 as molded within the mold.

Of course, the shield 72 and aperture therefor may nevertheless extend entirely through the housing without departing from the spirit and scope of the present invention.

Still referring to FIGS. 12 and 13, it is seen that the ground shield 72 has a pair of laterally arranged bumps 62, each one at a distal end of a pair of laterally arranged cantilevered beams 64. Thus, the ground shield 72 is positioned between a pair of adjacent ground pins 28, electrically contacts each of the pair of adjacent ground pins 28 by way of the bumps 62, and maintains an interference fit in the aperture space within which the ground shield 72 resides in the first direction by way of such bumps 62. Likewise, the ground shield 72 contacts an inner wall of the aperture space within which the ground shield 66 resides by way of a pair of laterally arranged bumps 68, each one at a distal end of a cantilevered beam 70. Thus, the ground shield 72 maintains an interference fit within the aperture space in the second direction by way of such bumps 68. As a result, and similar to the ground shield 66, the bumps 62, 68 of the ground shield 72 allow for a relatively high tolerance in the margin of error in the first and second directions in the aperture space within which such ground shield 72 is received.

As shown in FIGS. 12 and 13, only a single type of ground shield 72 is required for use in connection with the base 16, since the same type of ground shield may be used throughout. Nevertheless, differing types of ground shields 72 may be placed within the base 16 departing from the spirit and scope of the present invention as long as the bumps 62 thereof are in contact with corresponding ground pins 28 and the bumps 68 thereof each contact one of the opposing inner walls of the aperture space within which the ground shields 66 reside.

In the ground shield 72 shown in FIGS. 12 and 13, it is to be appreciated that the pair of bumps 68 thereon are redundant. That is, while both bumps 68 contribute to maintaining the interference fit in the second direction, such fit may also be achieved with only one bump 68. Moreover, it is to be appreciated that the ground shield 72 is positioned in the aperture space within which such ground shield 72 resides in the first direction solely by way of the ground pins 28 on either side thereof. That is, absence of one or both of such ground pins 28 would allow the ground shield 72 to shift in the first direction.

Figure 14:
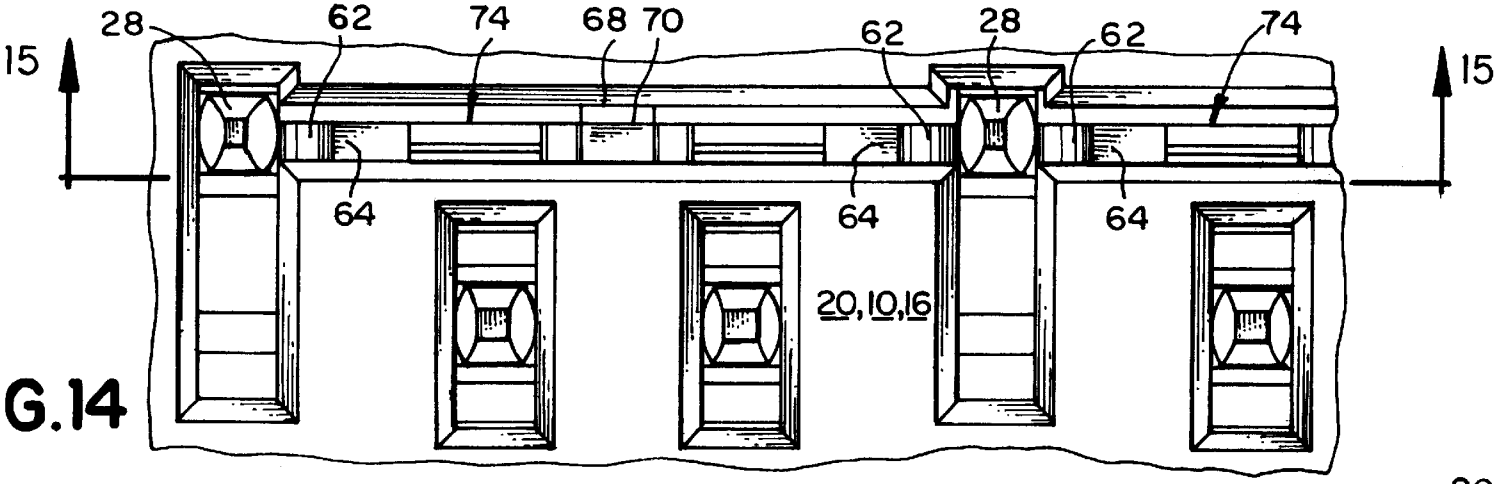
FIG. 14 is a plan view of a portion of the connector side of a header similar to the header of FIG. 1 in accordance with even still another embodiment of the present invention.
Figure 15:
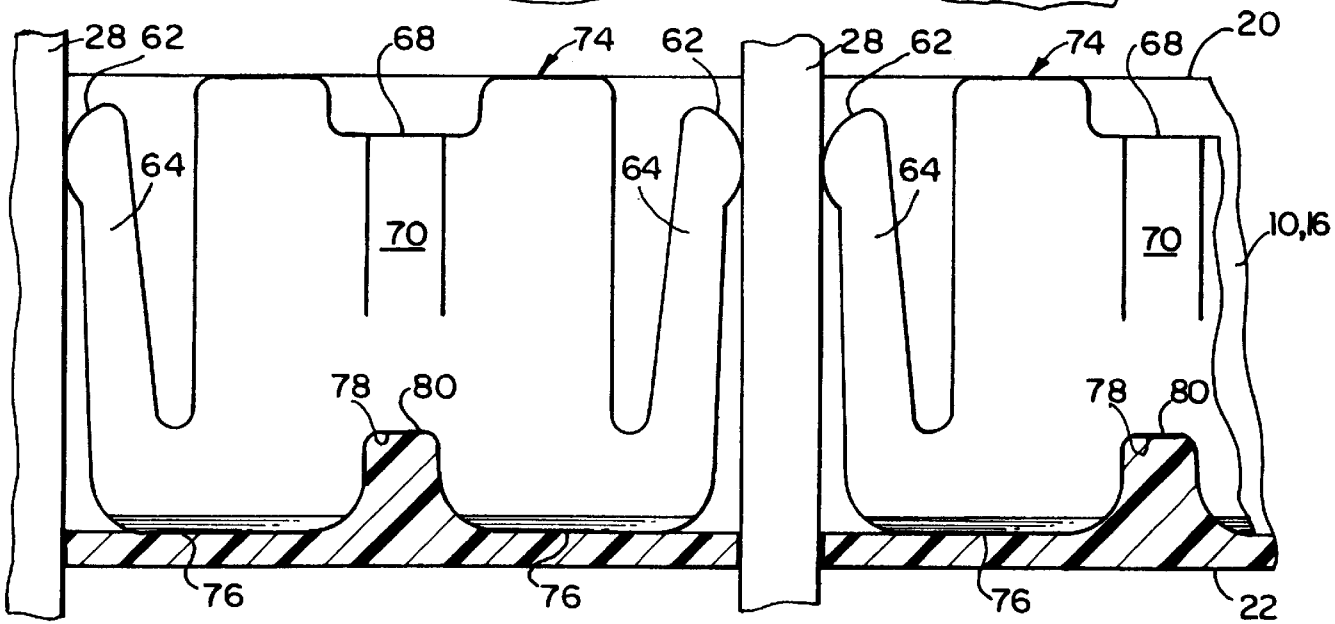
FIG. 15 is a cross-sectional view taken along the line 15—15 of FIG. 14, and shows the grounds shields of the header of FIG. 14.

In one embodiment of the present invention, then, and referring now to FIGS. 14 and 15, a still further modified ground shield 74 is introduced in place of the ground shield 72 of FIGS. 12 and 13. Such ground shield 74 is similar to ground shield 72 except that (1) the pair of bumps 68 have been replaced by a single bump 68; and (2) the bottom edge of the ground shield 74 includes a keying and stabilizing feature keyed to a corresponding feature within the aperture.

In particular, and still referring to FIGS. 14 and 15, it is seen that the pair of bumps 68 and pair of beams 70 on the ground shield 72 have been replaced on the ground shield 74 by a single bump 68 on a distal end of a cantilevered beam 70. Thus, the ground shield 74 maintains an interference fit within the aperture space in the second direction by way of such single bump 68. Moreover, the single bump 68 of the ground shield 74 allow for a relatively high tolerance in the margin of error in such second direction. Preferably, the single bump 68 and beam 70 are constructed to provide sufficient interference fit force, especially as compared with the pairs of bumps 68 and beams 70 of the ground shield 72 of FIGS. 12 and 13.

Also, the bottom or insertion edge 76 of the ground shield 74 includes a keying and stabilizing feature 78 keyed to a complementary feature 80 of the base 16 within the aperture. As shown in FIGS. 14 and 15, the feature 78 on the ground shield 74 defines a recess that matches a protrusion defined by the feature 80 of the base 16. The complementary features 78, 80 may define any appropriate geometry without departing from the spirit and scope of the present invention. Importantly, the complementary features 78, 80 associated with the ground shield 74 and base 16 assist in preventing any shifting of the ground shield 74 within the aperture space within which such ground shield 74 resides in the first direction. Thus, the ground shield 74 maintains an interference fit within the aperture space in the first direction by way of the bumps 62, and also at least partially by way of the features 78, 80. Moreover, the presence of the features 78, 80 relieves the bumps 62 and associated beams 64 from having to bear the full brunt of forces that would cause first direction shifting.

In the ground shield 74 shown in FIGS. 14 and 15, it is to be appreciated that the cantilevered beams 64 extend out and toward the connector side 20 of the base 16 when such ground shield 74 is inserted. If the ground shields 74 and ground pins 28 are both inserted into the base from the connector side 20, with the ground pins 28 being inserted before the ground shields 74, the direction of extension of such beams 64 is not believed to be an issue. In particular, the primary force on the beams 64 during insertion originates adjacent the bump 62 thereof and is generally lateral and toward the direction of deflection, and is therefore not potentially injurious to such beams 64. In contrast, If the ground pins 28 are inserted after the ground shields 74, the direction of extension of such beams 64 becomes an issue. In particular, the primary force on the beams 64 during insertion originates adjacent the bump 62 thereof and is generally longitudinal and toward the juncture of the beam 64 and the remainder of the shield 74, and therefore may cause the beam 64 to crumple.

Figure 16:
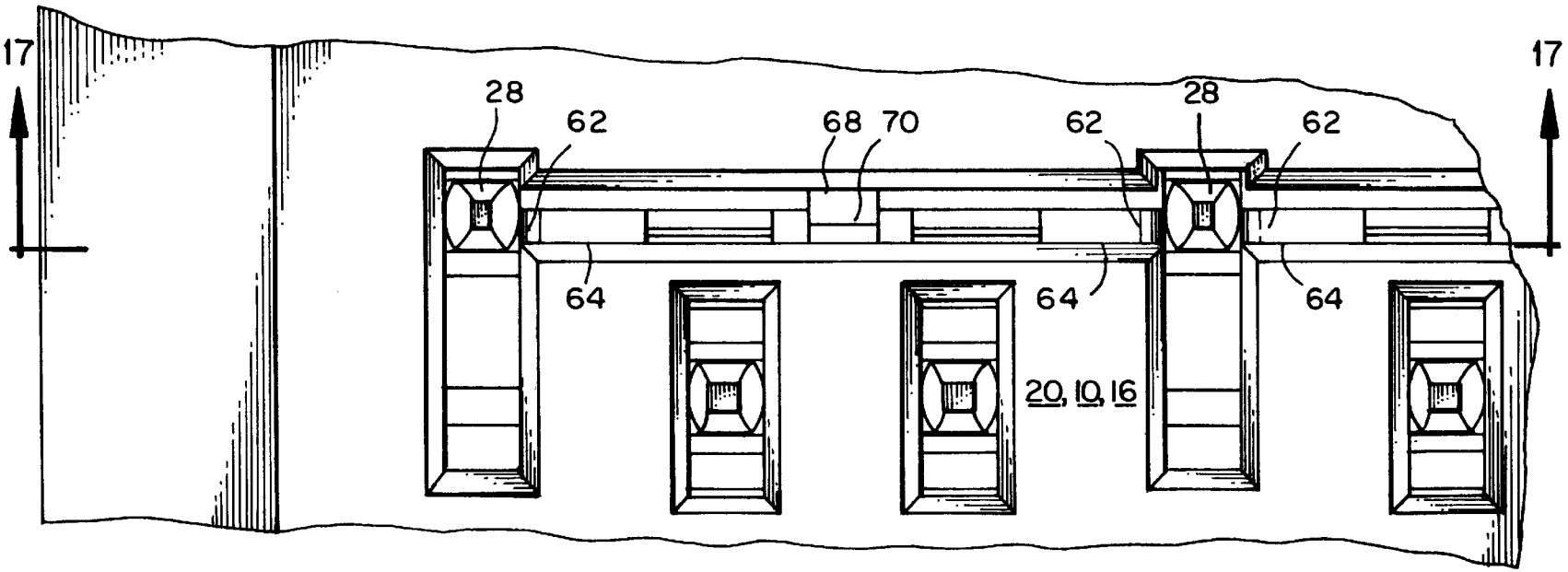
FIG. 16 is a plan view of a portion of the connector side of a header similar to the header of FIG. 1 in accordance with still further another embodiment of the present invention.
Figure 17:
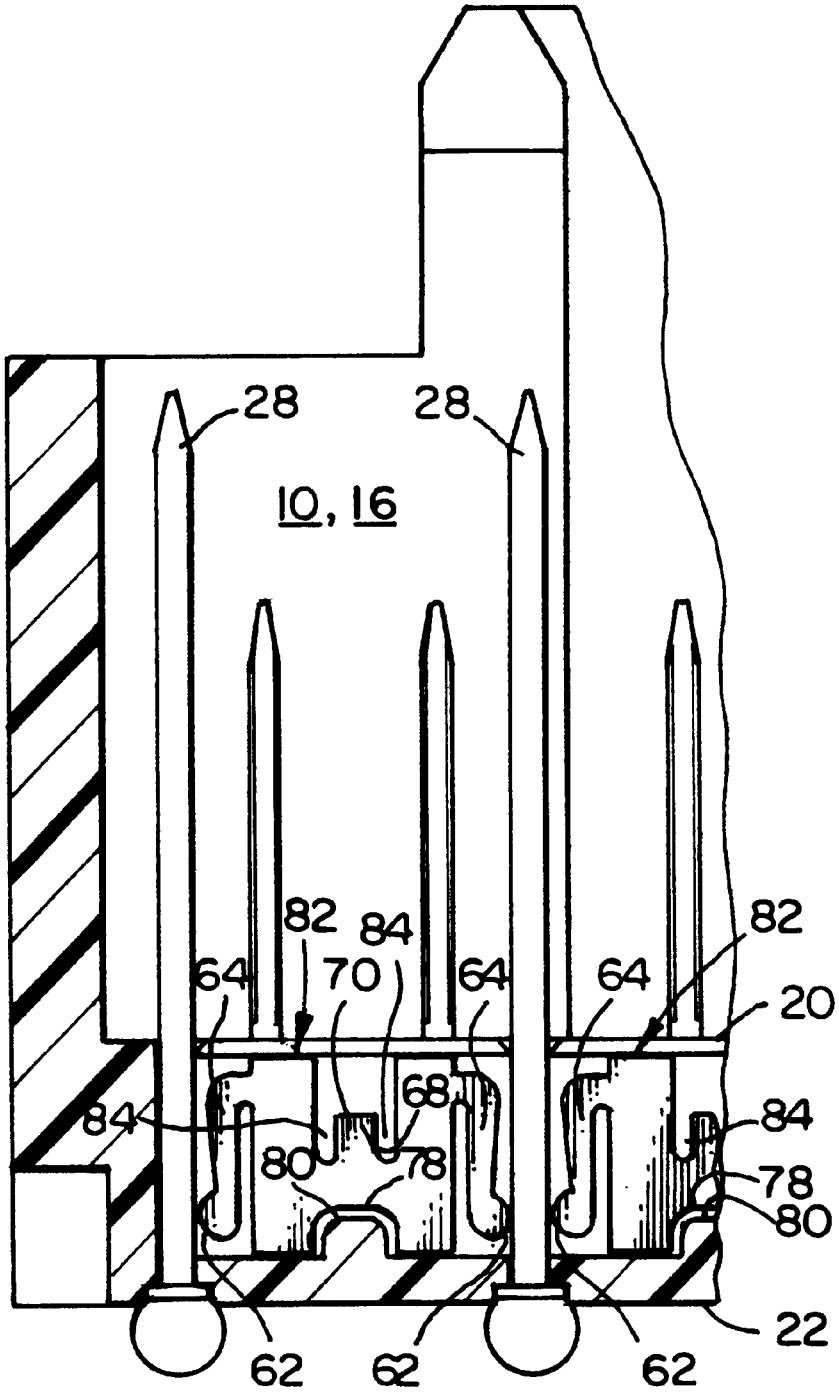
FIG. 17 is a cross-sectional view taken along the line 17—17 of FIG. 16, and shows the grounds shields of the header of FIG. 16.

In one embodiment of the present invention, then, and referring now to FIGS. 16 and 17, a still further modified ground shield 82 is introduced to accommodate the situation where the ground shields 82 and ground pins 28 are both inserted into the base from the connector side 20, with the ground pins 28 being inserted after the ground shields 82. As may be appreciated, such ground shield 82 is similar to ground shield 74 except that the cantilevered beams 64 in the ground shield 76 extend out and toward the backplane side 22 of the base 16 when such ground shield 76 is inserted.

Thus, if the ground shields 82 and ground pins 28 are both inserted into the base from the connector side 20, with the ground pins 28 being inserted after the ground shields 82, the direction of extension of the beams 64 of such ground shield 82 are not believed to be an issue. In particular, the primary force on the beams 64 during insertion originates adjacent the bump 62 thereof and is generally lateral and toward the direction of deflection, and is therefore not potentially injurious to such beams 64.

Note that the ground shield 82 differs from the ground shield 74 in the design of the main body of the ground shield 82 adjacent the single bump 68 on a distal end of the cantilevered beam 70. In particular, the single beam 70 is defined in the ground shield 74 by parallel lancing operations originating at the edge of such ground shield 74 that resides at the connector side 20 once inserted into the base 16, where such lancing operations take place after the ground shield 74 is stamped or otherwise formed in general. In contrast, the single beam 70 is defined in the ground shield 82 by wells 84 on either side thereof that originate when the ground shield 82 is stamped or otherwise formed in general. Thus, the lancing operations are obviated, and the beam 70 in the ground shield 82 is more clearly delineated.

In the foregoing description, it can be seen that the present invention comprises new and useful ground shield 60, 66, 72, 74, 82 for use within a header 10 having multiple differential signal pairs 24*p* in relatively high density, where the ground shield imparts the header with a relatively high tolerance for margins of error in dimensions of parts thereof. It should be appreciated by those skilled in the art that changes could be made to the embodiments described above without departing from the inventive concepts thereof. It is understood, therefore, that this invention is not limited to the particular embodiments disclosed, but it is intended to cover modifications within the spirit and scope of the present invention as defined by the appended claims.

What is claimed is:

1. An electrical connector, comprising:

a base defining a plurality of aperture spaces therein;

a plurality of contacts received within the aperture spaces of the base and secured within the aperture spaces of the base, including signal contacts and ground contacts; and a plurality of ground shields received within the aperture spaces of the base and secured within the aperture spaces of the base, the ground shields being positioned within the base to shield selected ones of the signal contacts within the base from noise and/or cross-talk generated by other signal contacts within the base, each ground shield having an electrical contact site at which the ground shield is in physical and electrical contact with a ground contact, the electrical contact site being flexible, wherein each ground shield includes a cantilevered beam and the electrical contact site is located at a distal end of the cantilevered beam, wherein the cantilevered beam extends out from each ground shield at a lateral side thereof, and wherein each ground shield is generally planar and the beam resides in and cantilevers within the general plane of the ground shield, the beam allowing the ground shield to maintain an interference fit in the planar extent thereof within the base.

2. The connector of claim 1 wherein each ground shield further has an insertion edge, and wherein the cantilevered beam extends out and toward the insertion edge.

3. The connector of claim 1 wherein each ground shield further has an insertion edge, and wherein the cantilevered beam extends out and away from the insertion edge.

4. The connector of claim 1 wherein said signal contacts are arranged in rows and columns, the ground pins are arranged in rows and columns, the ground shields are arranged in rows and columns, each row of the ground shields resides between adjacent rows of the signal pins, and each column of the ground shields corresponds to and is coextensive with a column of the signal pins.

5. The connector of claim 1 wherein each ground shield has a non-electrical contact site at which the ground shield is in physical contact with the base, the non-electrical contact site being flexible.

6. The connector of claim 5 wherein each ground shield includes a cantilevered beam and the non-electrical contact site is located at a distal end of the cantilevered beam.

7. The connector of claim 6 wherein each ground shield is generally planar and the cantilevered beam extends out from the ground shield at a planar side thereof.

8. The connector of claim 7 wherein the beam extends outside of and cantilevers away from the general plane of the ground shield, the beam allowing the ground shield to maintain an interference fit generally perpendicular to the planar extent thereof within the base.

9. The connector of claim 6 wherein the cantilevered beam is defined in the ground shield by lanced cuts originating at an edge thereof.

10. The connector of claim 6 wherein the cantilevered beam is defined in the ground shield by wells on either side of the beam.

11. The connector of claim 1 wherein each ground shield generally extends through the base between surfaces of opposing sides thereof.

12. The connector of claim 1 wherein each ground shield generally extends through the base between a surface at one opposing side thereof and a point short of a surface at another opposing side thereof.

13. The connector of claim 1 wherein each ground shield has a pair of generally opposing electrical contact sites, the ground shield being in physical and electrical contact with a ground contact at each electrical contact site, each electrical contact site being flexible.

14. The connector of claim 13 wherein each ground shield includes a pair of generally opposing cantilevered beams and each electrical contact site is located at a distal end of a respective cantilevered beam.

15. The connector of claim 14 wherein each cantilevered beam extends out from the ground shield at an opposing lateral side thereof adjacent a contacted-to ground contact.

16. The connector of claim 15 wherein each ground shield is generally planar and each beam resides in and cantilevers within the general plane of the ground shield, the beams allowing the ground shield to maintain an interference fit in the planar extent thereof within the base.

17. The connector of claim 14 wherein each ground shield further has an insertion edge, and wherein each cantilevered beam extends out and toward the insertion edge.

18. The connector of claim 14 wherein each ground shield further has an insertion edge, and wherein each cantilevered beam extends out and away from the insertion edge.

19. The connector of claim 13 wherein said signal contacts are arranged in rows and columns, the ground pins are arranged in rows and columns, the ground shields are arranged in rows and columns, each row of the ground shields resides between adjacent rows of the signal pins, and each column of the ground shields corresponds to and is coextensive with a pair of columns of the signal pins.

20. The connector of claim 13 wherein each ground shield has a non-electrical contact site at which the ground shield is in physical contact with the base, the non-electrical contact site being flexible.

21. The connector of claim 20 wherein each ground shield includes a cantilevered beam and the non-electrical contact site is located at a distal end of the cantilevered beam.

22. The connector of claim 21 wherein each ground shield is generally planar and the cantilevered beam extends out from the ground shield at a planar side thereof.

23. The connector of claim 22 wherein the beam extends outside of and cantilevers away from the general plane of the ground shield, the beam allowing the ground shield to maintain an interference fit generally perpendicular to the planar extent thereof within the base.

24. The connector of claim 20 wherein each ground shield has a pair of non-electrical contact sites at which the ground shield is in physical contact with the base, each non-electrical contact site being flexible.

25. The connector of claim 13 wherein each ground shield further has an insertion edge defining a keying and stabilizing feature keyed to a corresponding feature within the base.

26. The connector of claim 25 wherein the insertion edge defines a keying and stabilizing featured which is a recess that corresponds to a protrusion within the base.

27. A ground shield for being received and secured within an electrical connector comprising a base defining a plurality of aperture spaces therein and a plurality of contacts received and secured within the aperture spaces, including signal contacts and ground contacts, the ground shield for being received and secured within one of the aperture spaces and for being positioned to shield selected ones of the signal contacts from noise and/or cross-talk generated by other signal contacts within the base, the ground shield having an electrical contact site at which the ground shield is to be in physical and electrical contact with a ground contact, the electrical contact site being flexible, the ground shield including a cantilevered beam and the electrical contact site being located at a distal end of the cantilevered beam, the cantilevered beam extending out from the ground shield at a lateral side thereof, the ground shield being generally planar and the beam residing in and cantilevering within the general plane of the ground shield, the beam allowing the ground shield to maintain an interference fit in the planar extent thereof within the base.

28. The ground shield of claim 27 further having an insertion edge, wherein the cantilevered beam extends out and toward the insertion edge.

29. The ground shield of claim 27 having an insertion edge, wherein the cantilevered beam extends out and away from the insertion edge.

30. The ground shield of claim 27 having a non-electrical contact site at which the ground shield is to be in physical contact with the base, the non-electrical contact site being flexible.

31. The ground shield of claim 30 including a cantilevered beam, the non-electrical contact site being located at a distal end of the cantilevered beam.

32. The ground shield of claim 31 wherein such ground shield is generally planar and the cantilevered beam extends out from the ground shield at a planar side thereof.

33. The ground shield of claim 32 wherein the beam extends outside of and cantilevers away from the general plane of the ground shield, the beam allowing the ground shield to maintain an interference fit generally perpendicular to the planar extent thereof within the base.

34. The ground shield of claim 31 wherein the cantilevered beam is defined in the ground shield by lanced cuts originating at an edge thereof.

35. The ground shield of claim 31 wherein the cantilevered beam is defined in the ground shield by wells on either side of the beam.

36. The ground shield of claim 27 having a pair of generally opposing electrical contact sites, the ground shield being in physical and electrical contact with a ground contact at each electrical contact site, each electrical contact site being flexible.

37. The ground shield of claim 36 including a pair of generally opposing cantilevered beams, each electrical contact site being located at a distal end of a respective cantilevered beam.

38. The ground shield of claim 37 wherein each cantilevered beam extends out from the ground shield at an opposing lateral side thereof adjacent a contacted-to ground contact.

39. The ground shield of claim 38 wherein such ground shield is generally planar and each beam resides in and cantilevers within the general plane of the ground shield, the beams allowing the ground shield to maintain an interference fit in the planar extent thereof within the base.

40. The ground shield of claim 37 having an insertion edge, each cantilevered beam extending out and toward the insertion edge.

41. The ground shield of claim 37 having an insertion edge, each cantilevered beam extending out and away from the insertion edge.

42. The ground shield of claim 36 having a non-electrical contact site at which the ground shield is in physical contact with the base, the non-electrical contact site being flexible.

43. The ground shield of claim 42 including a cantilevered beam, the non-electrical contact site being located at a distal end of the cantilevered beam.

44. The ground shield of claim 43 wherein each ground shield is generally planar and the cantilevered beam extends out from the ground shield at a planar side thereof.

45. The ground shield of claim 44 wherein the beam extends outside of and cantilevers away from the general plane of the ground shield, the beam allowing the ground shield to maintain an interference fit generally perpendicular to the planar extent thereof within the base.

46. The ground shield of claim 42 having a pair of non-electrical contact sites at which the ground shield is in physical contact with the base, each non-electrical contact site being flexible.

47. The ground shield of claim 36 having an insertion edge defining a keying and stabilizing feature keyed to a corresponding feature within the base.

48. The ground shield of claim 47 wherein the insertion edge defines a keying and stabilizing featured which is a recess that corresponds to a protrusion within the base.

* * * * *